US007513814B2

(12) United States Patent
Kobayashi et al.

(10) Patent No.: US 7,513,814 B2
(45) Date of Patent: Apr. 7, 2009

(54) METHOD OF MANUFACTURING ELECTRON-EMITTING DEVICE, ELECTRON SOURCE USING ELECTRON-EMITTING DEVICE, METHOD OF MANUFACTURING IMAGE DISPLAY APPARATUS, AND INFORMATION DISPLAY REPRODUCTION APPARATUS USING IMAGE DISPLAY APPARATUS MANUFACTURED BY THE METHOD

(75) Inventors: Tamaki Kobayashi, Isehara (JP); Keisuke Yamamoto, Yamato (JP); Hisashi Sakata, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 653 days.

(21) Appl. No.: 11/159,308

(22) Filed: Jun. 23, 2005

(65) Prior Publication Data

US 2006/0003660 A1 Jan. 5, 2006

(30) Foreign Application Priority Data

Jul. 1, 2004 (JP) ..... 2004-195699

(51) Int. Cl.
*H01J 9/00* (2006.01)
*H01J 9/24* (2006.01)

(52) U.S. Cl. ..... 445/24; 445/52; 445/6; 445/3; 445/5; 313/495

(58) Field of Classification Search ..... 445/24–26, 445/49–51, 3, 6; 315/169.1–169.3; 324/41–412
See application file for complete search history.

(56) References Cited

U.S. PATENT DOCUMENTS 5,591,061 A 1/1997 Ikeda et al. ..... 445/3
5,847,495 A 12/1998 Yamanobe et al. ..... 313/310
6,147,449 A 11/2000 Iwasaki et al. ..... 313/495
6,169,356 B1 1/2001 Ohnishi et al. ..... 313/495
6,171,162 B1 1/2001 Iwasaki et al. ..... 445/6
6,179,678 B1 1/2001 Kishi et al. ..... 445/24
6,184,610 B1 2/2001 Shibata et al. ..... 313/309
6,225,749 B1 5/2001 Kobayashi et al. ..... 315/169.3
6,246,168 B1 6/2001 Kishi et al. ..... 313/495
6,267,636 B1 7/2001 Onishi et al. ..... 445/6

(Continued)

FOREIGN PATENT DOCUMENTS

JP 2000-306500 11/2000

(Continued)

OTHER PUBLICATIONS

Busta, H., et al., *Low-voltage electron emission from "tipless" field emitter arrays*, Applied Physics Letters, 78, No. 22, 28 3418-3420, (May 2001).

(Continued)

*Primary Examiner*—Sikha Roy
*Assistant Examiner*—Jose M Diaz
(74) *Attorney, Agent, or Firm*—Fitzpatrick, Cella, Harper & Scinto

(57) ABSTRACT

An effective voltage V' effectively applied to a gap 7 during an "activation step" is controlled to a desired value. In the "activation step", a voltage is repeatedly applied between a first electroconductive film 4*a* and a second electroconductive film 4*b* while controlling voltages outputted from a voltage source 51 so that a value $\beta_{effect}$ becomes a desired value.

12 Claims, 13 Drawing Sheets

U.S. PATENT DOCUMENTS

| | | | | |
|---|---|---|---|---|
| 6,334,801 | B1 | 1/2002 | Kawade et al. | 445/24 |
| 6,346,773 | B1 * | 2/2002 | Takegami | 315/169.1 |
| 6,379,211 | B2 | 4/2002 | Onishi et al. | 445/73 |
| 6,409,563 | B1 | 6/2002 | Tamura et al. | 445/3 |
| 6,534,924 | B1 | 3/2003 | Oguchi et al. | 315/169.1 |
| 6,608,437 | B1 | 8/2003 | Kishi et al. | 313/495 |
| 6,617,773 | B1 | 9/2003 | Yamamoto et al. | 313/310 |
| 6,626,719 | B2 | 9/2003 | Ono et al. | 445/24 |
| 6,633,118 | B1 | 10/2003 | Yamamoto et al. | 313/495 |
| 6,642,649 | B1 | 11/2003 | Yamamoto et al. | 313/495 |
| 6,726,520 | B2 | 4/2004 | Takeda et al. | 445/62 |
| 6,731,060 | B1 | 5/2004 | Yamamoto et al. | 313/495 |
| 6,802,753 | B1 | 10/2004 | Ando et al. | 445/6 |
| 6,822,397 | B2 | 11/2004 | Kawasaki et al. | 315/169.2 |
| 6,831,401 | B1 | 12/2004 | Yamamoto et al. | 313/495 |
| 6,848,962 | B2 * | 2/2005 | Kitamura et al. | 445/24 |
| 6,849,999 | B1 | 2/2005 | Kobayashi et al. | 313/495 |
| 6,876,156 | B1 | 4/2005 | Yamamoto et al. | 315/169.3 |
| 6,960,111 | B2 * | 11/2005 | Takegami et al. | 445/24 |
| 7,021,981 | B2 | 4/2006 | Onishi et al. | 445/6 |
| 7,057,336 | B2 | 6/2006 | Kishi et al. | 313/495 |
| 7,249,990 | B2 * | 7/2007 | Shimazu et al. | 445/50 |
| 2005/0035703 | A1 | 2/2005 | Yamamoto et al. | 313/495 |
| 2005/0040751 | A1 | 2/2005 | Yamamoto et al. | 313/311 |
| 2005/0194912 | A1 | 9/2005 | Kobayashi et al. | 315/169.1 |
| 2005/0225230 | A1 | 10/2005 | Takeda et al. | 313/496 |
| 2005/0236952 | A1 | 10/2005 | Moriguchi et al. | 313/310 |
| 2005/0236965 | A1 | 10/2005 | Yamamoto et al. | 313/496 |
| 2005/0258734 | A1 | 11/2005 | Nokanobu et al. | 313/495 |

FOREIGN PATENT DOCUMENTS

| | | |
|---|---|---|
| JP | 2000-311593 | 11/2000 |

OTHER PUBLICATIONS

Busta H., et al., *Performance of nanocrystalline graphite field emitters*, Solid-State Electronics 45 1039-1047, ( 2001).

Robertson J., *Electron Field emission from diamond and diamond-like carbon for field emission displays*, Carbon 37 759-763, (1999).

Xu, N.S., *Similarities in the "cold" electron emission characteristics of diamond coated molybdenum electrodes and polished bulk graphite surfaces*, J. Phys. D: Appl. Phys., 26, 1776-1780, (1993).

* cited by examiner

METHOD OF MANUFACTURING ELECTRON-EMITTING DEVICE, ELECTRON SOURCE USING ELECTRON-EMITTING DEVICE, METHOD OF MANUFACTURING IMAGE DISPLAY APPARATUS, AND INFORMATION DISPLAY REPRODUCTION APPARATUS USING IMAGE DISPLAY APPARATUS MANUFACTURED BY THE METHOD

BACKGROUND OF THE INVENTION

1. Field of the Invention

The present invention relates to a method of manufacturing an electron-emitting device, an electron source using the electron-emitting device, and a method of manufacturing an image display device. Furthermore, the present invention relates to an information display reproduction apparatus using the image display device.

2. Description of Related Art

There is a surface conduction electron-emitting device as one of electron-emitting devices. As shown in Japanese Patent Application Laid-Open Publication No. 2000-311593 and Japanese Patent Application Laid-Open Publication No. 2000-306500, in a method of manufacturing the surface conduction electron-emitting device, an electron-emitting area is formed by executing a "forming step" for forming a gap in a part of an electroconductive film connecting a pair of electrodes to each other by applying Joule heat generated by passing an electric current through the electroconductive film, and by performing a processing called as an "activation step".

The "activation step" can be performed by repeatingly applying a pulse voltage to the electroconductive film to which the "forming step" has performed under an atmosphere including a gas containing carbon as in the case of the "forming step." By the "activation step", a carbon film containing carbon or carbon compounds derived from the gas containing carbon, which is existing in the atmosphere, is deposited on an electroconductive film, formed by the "forming step", and is deposited in the gap or in the neighborhood of the gap. Thereby, a device current If and an emission current Ie are remarkably improved, and a better electron emission characteristic can be obtained. Incidentally, the device current If is a current flowing through the pair of electrodes when a voltage is applied to the pair of electrodes. Moreover, the emission current Ie is a current emitted from the electron-emitting device when a voltage is applied to the pair of electrodes.

In the Japanese Patent Applications described above, a voltage applying step such as the "activation step" in a manufacturing process of an electron-emitting device is performed by connecting a plurality of electron-emitting devices to a common wiring to apply a voltage to the plurality of electron-emitting devices through the wiring substantially at the same time. Consequently, it is taught that a voltage effectively applied to each electron-emitting device is shifted from a desired value owing to a voltage drop caused by wiring resistance. Then, the above described Japanese Patent Applications teach that a current If flowing through each electron-emitting device (or a current flowing through the wiring connected to each electron-emitting device) is measured to compensate the amount of the voltage drop by the wiring based on the measured value for applying a voltage to each electron-emitting device (or to the wiring connected to each electron-emitting device).

An electron source equipped with a plurality of electron-emitting devices manufactured through such processing is applied to image display devices such as a flat panel display (flat panel type image display device). In such an image display device, the uniformity of a displayed image depends on the electron emission characteristic of each electron-emitting device. Accordingly, in the method of manufacturing an electron-emitting device, a technique realizing a desired electron emission characteristic with high reproducibility is required. Then, moreover, in the method of manufacturing an electron source equipped with a plurality of electron-emitting devices arranged on a same substrate, a technique for decreasing the electron emission characteristic differences among the electron-emitting devices is required.

SUMMARY OF THE INVENTION

However, in order to achieve further improvement of the uniformity and reproducibility of an electron emission characteristic, it is necessary to consider voltage drops by the resistances of the electrodes constituting each electron-emitting device and by the resistance of an electroconductive film in addition to the voltage drop by the wiring resistance mentioned above.

Accordingly, in order to eliminate the influence of the voltage drop, it is necessary to take into consideration the resistances of the members connected to the electron-emitting area in series as many as possible. It becomes possible to perform more accurate voltage compensation ("voltage correction" or "voltage adjustment") by measuring the device current If as well as these resistances.

In particular, because the electroconductive film mentioned above is also a very thin film, the resistance thereof is not always fixed, for example, in the "activation step." For example, it is conceivable that a change is produced on an electroconductive film and the like according to a change of the current (device current If) flowing between the electrodes and consequently a resistance changes. However, in such a case where the resistance of the electroconductive film or the like changes, it has been difficult to compensate (control or adjust or correct) the voltage applied to the wiring sufficiently according to the resistance change by the conventional technique.

It is an object of the present invention to provide a manufacturing method adjusting a voltage outputted from a voltage source (a pulse generator or a voltage pulse generator) in order that a voltage effectively applied to an electron-emitting area, for example, during the "activation step" may be a desired value.

The present invention accomplished in order to solve the above-mentioned problem is a method of manufacturing an electron-emitting device, the method including the steps of:

preparing a first electroconductive film and a second electroconductive film, which are opposed to each other and connected to a voltage source outputting a voltage; and repeatedly applying a voltage output from the voltage source to the first and second electroconductive films, wherein the step of repeatedly applying the voltage includes:

(A) a first measuring step of measuring a first current $I_1$ which passes through the first and second electroconductive films in response to outputting a first voltage $V_1$ from the voltage source;

(B) a second measuring step of measuring a second current $I_{12}$ which passes through the first and second electroconductive films in response to outputting a second voltage $V_{12}$ from the voltage source, wherein a voltage value of the second voltage $V_{12}$ is different from that of the first voltage $V_1$;

(C) a first calculating step of calculating a first effective voltage $V_1'$ and a second effective voltage $V_{12}'$, which are applied between the first and second electroconductive films in response to outputting the first and second voltages from the voltage source respectively, based on the first current $I_1$, the second current $I_2$, the first voltage $V_1$, and the second voltage $V_{12}$;

(D) a second calculating step of calculating a value $\beta_{effect}$ defined by the following equation (1):

$$\beta_{effect}=\{(1/V_1')-(1/V_{12}')\}/\{\ln(I_{12}/V_{12}'^2)-\ln(I_1/V_1'^2)\} \quad (1); \text{ and}$$

(E) an adjusting step of adjusting a voltage which is output from the voltage source so as to reduce a difference between the value $\beta_{effect}$ and a set value $\beta_{set}$.

Moreover, in the present invention, the first effective voltage $V_1'$ is a value obtained by assigning a preset initial value $R_1$ to $R_{unknown}$ in the following equation (2), and by assigning a combination of the first voltage $V_1$ and the first current $I_1$ to the V and the I. The second effective voltage $V_{12}'$ is a value obtained by assigning the preset initial value $R_1$ to $R_{unknown}$ in the following equation (2), and by assigning a combination of the second voltage $V_{12}$ and the second current $I_{12}$ to the V and the I.

$$V'=V-I\times R_{unknown} \quad (2)$$

Moreover, in the present invention, a voltage calculating step and a re-executing step are repeated until there is no difference between the value $\beta_{effect}$ and the set value $\beta_{set}$, the voltage calculating step calculating a new first voltage $V_1$ and/or a new second voltage $V_{12}$ by assigning a value $R_2$, which is a value larger than the initial value $R_1$, to $R_{unknown}$, and by assigning a combination of the first effective voltage $V_1'$ and the first current $I_1$ or a combination of the second effective voltage $V_{12}'$ and the second current $I_{12}$ in the equation (2), respectively, when the value $\beta_{effect}$ is larger than the set value $\beta_{set}$, or calculating the new first voltage $V_1$ and/or the new second voltage $V_{12}$ by assigning a value $R_3$, which is a value smaller than the initial value $R_1$, to $R_{unknown}$, and by assigning the combination of the first effective voltage $V_1'$ and the first current $I_1$ or the combination of the second effective voltage $V_{12}'$ and the second current $I_{12}$ in the equation (2), respectively, when the value $\beta_{effect}$ is smaller than the set value $\beta_{set}$, the re-executing step executing the first measuring step, the second measuring step, the first calculating step, the second calculating step, and the adjusting step again by replacing the new first voltage $V_1$ and/or the new second voltage $V_{12}$ with the first voltage $V_1$ and/or the second voltage $V_{12}$ in the measuring steps.

Moreover, in the present invention, a voltage calculating step and a re-executing step are repeated until the difference between the value $\beta_{effect}$ and the set value $\beta_{set}$ converges, the voltage calculating step calculating a new first voltage $V_1$ and/or a new second voltage $V_{12}$ by assigning a value $R_2$, which is a value larger than the initial value $R_1$, to $R_{unknown}$, and by assigning a combination of the first effective voltage $V_1'$ and the first current $I_1$ or a combination of the second effective voltage $V_{12}'$ and the second current $I_{12}$ in the equation (2), respectively, when the value $\beta_{effect}$ is larger than the set value $\beta_{set}$, or calculating the new first voltage $V_1$ and/or the new second voltage $V_{12}$ by assigning a value $R_3$, which is a value smaller than the initial value $R_1$, to $R_{unknown}$, and by assigning the combination of the first effective voltage $V_1'$ and the first current $I_1$ or the combination of the second effective voltage $V_{12}'$ and the second current $I_{12}$ in the equation (2), respectively, when the value $\beta_{effect}$ is smaller than the set value $\beta_{set}$, the re-executing step executing the first measuring step, the second measuring step, the first calculating step, the second calculating step, and the adjusting step again by replacing the new first voltage $V_1$ and/or the new second voltage $V_{12}$ with the first voltage $V_1$ and/or the second voltage $V_{12}$ in the measuring steps.

Moreover, the present invention is also characterized in "that the first voltage $V_1$ and the second voltage $V_{12}$ are repeatedly outputted at specified time intervals from the voltage source in the state of being included in a step-wise pulse," "that the adjusting step is started at a point of time when the value $\beta_{effect}$ becomes half as large again as the set value $\beta_{set}$ or less," "that the first voltage $V_1$ or the second voltage $V_{12}$ is within a range of from 15 V to 60 V both inclusive," "that the value $R_1$ is within a range of from 0 Ω to 40 kΩ both inclusive," and "that the set value $\beta_{set}$ is within a range of from 0.00338 to 0.00508 both inclusive."

Moreover, as another aspect of the present invention, a method of manufacturing an electron source equipped with a plurality of electron-emitting devices, wherein each of the plurality of electron-emitting device is manufactured by the method of manufacturing an electron-emitting device described above. Then, in the method of manufacturing the electron source, every predetermined number of the plurality of electron-emitting devices is manufactured by the method of manufacturing an electron-emitting device of the present invention described above.

Moreover, as a further aspect of the present invention, a method of manufacturing an image display device equipped with an electron source and a luminous body, wherein the electron source is manufactured by the method of manufacturing an electron source described above.

Moreover, as a still further aspect of the present invention, an information display reproduction apparatus provided with at least a receiver outputting at least one of image information, character information, and sound information included in a received broadcast signal, and an image display device connected to the receiver, wherein the image display device is manufactured by the method of manufacturing method of an image display device described above.

According to the manufacturing method of the present invention, the dispersion of the electron emission characteristic of an electron-emitting device can be restrained, and consequently it is possible to provide the electron source having high uniformity and the image display device using the electron source. Moreover, according to the present invention, an electron-emitting device can be formed with good reproducibility. Moreover, to put it concretely, even when an unknown resistance connected to the electron-emitting device in series changes with time, it is possible to control (adjust or correct) the voltage applied to the electron-emitting area to be a desired value during the "activation step", for example.

DETAILED DESCRIPTION OF THE PREFERRED EMBODIMENTS

Hereinafter, an example of a method of manufacturing an electron-emitting device of the present invention is described in detail every step with reference to FIGS. 3A-3D.

(Step 1)

Figure 3A:
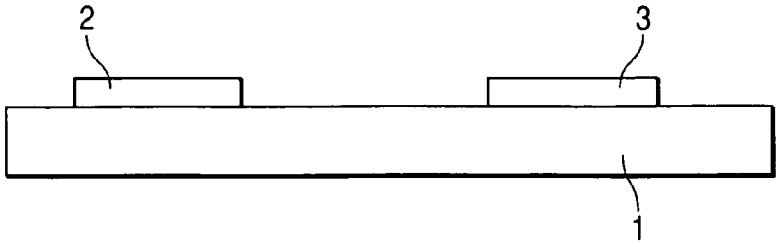
FIGS. 3A, 3B, 3C, and 3D are schematic views illustrating a manufacturing process of the electron-emitting device.

A first electrode 2 and a second electrode 3 are formed on a substrate 1 (FIG. 3A).

To put it concretely, after the substrate 1 has been fully washed with a detergent, pure water, an organic solvent, and the like, an electrode material is deposited on the substrate 1 by a vacuum evaporation method, a sputter technique, and the like. After that, the electrodes 2 and 3 can be formed using, for example, a photolithography technique.

As the substrate 1, silica glass, glass having a decreased impurity content such as Na, soda lime glass, substrate composed of soda lime glass and a silicon oxide film (typically $SiO_2$ film) laminated on the soda lime glass by a sputter technique or the like, a ceramic substrate made of alumina or the like, silicon substrate, and the like can be used.

As the materials of the electrodes 2 and 3, general conductor materials can be used. For example, the material can be suitably selected among metals or alloys such as Ni, Cr, Au, Mo, W, Pt, Ti, A, Cu, and Pd; printed conductors composed of metals or metallic oxides such as Pd, Ag, Au, $RuO_2$, and Pd—Ag, and glass or the like; transparent conductive materials such as $In_2O_3$—$SnO_2$; semiconductor conductor materials such as polysilicon; and the like.

An interval L between the electrodes 2 and 3, the widths W of the electrodes 2 and 3 (the widths W are the lengths of the electrodes 2 and 3 in the direction substantially perpendicular to the direction in which the electrodes 2 and 3 are opposed), the width W' of the electroconductive film 4, and the like are designed in consideration of the applied form and the like. See FIG. 2A about the interval L, the widths W, and the width W'.

The interval L between the electrodes 2 and 3 is preferably within a range of from 100 nm to 900 μm, and more preferably within a range of from 1 μm to 100 μm in consideration of the voltage applied between the electrodes 2 and 3.

The widths W of the electrodes 2 and 3 are preferably within a range of from 1 μm to 500 μm in consideration of the resistance values of the electrodes 2 and 3 and an electron emission characteristic. The film thicknesses of the electrodes 2 and 3 are preferably within a range of from 10 nm to 10 μm.

(Step 2)

Figure 3B:
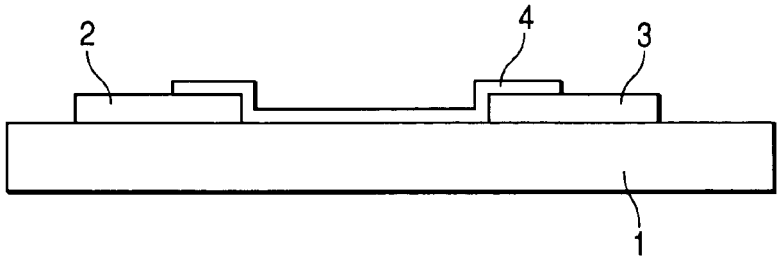

The electroconductive film 4 is formed so as to connect the first electrode 2 and the second electrode 3 with each other (FIG. 3B).

To put it concretely, first, an organometallic solution is coated on the substrate 1 provided with the electrodes 2 and 3 to form an organometallic film. A solution of an organic metallic compound containing the metal of the material of the electroconductive film 4 as the main element can be used for the organometallic solution. Subsequently, after performing a baking processing of the organic metal film, the baked organometallic film is patterned to a desired shape by lift-off, etching, or the like to form the electroconductive film 4. As the coating method of the organometallic solution, a dipping method, a spinner method, an ink-jet method, and the like can be also used.

Although the film thickness of the electroconductive film 4 is suitably selected depending on the covering of the ends (stepped portions) of the electrodes 2 and 3, the resistance value of the electroconductive film 4, the forming condition of the electroconductive film 4, which will be described later, and the like, it is preferable that the film thickness is within a range of from 5 nm to 50 nm.

Moreover, in the case where the "forming processing" is performed at Step 3, which will be described later, the resistance value of the electroconductive film 4 preferably has a certain degree of largeness in order to make it easy to perform the forming step. To put it concretely, the resistance value is preferably within a range of from $10^3$ Ω/□ to $10^7$ Ω/□. On the other hand, the electroconductive film 4 preferably has a low resistance after the "forming processing" (after the formation of a gap 5) in order to make it possible to apply a sufficient voltage to the gap 5 through the electrodes 2 and 3.

As the materials of the electroconductive film 4, metals such as Pd, Pt, Ru, Ag, and Au, oxides such as PdO, $SnO_2$, and $In_2O_3$, borides such as $HfB_2$, carbides such as TiC and SiC, nitrides such as TiN, semiconductors such as Si and Ge, and the like can be cited.

Moreover, as the method of forming the electroconductive film 4, various techniques such as an ink-jet coating method, a spin coat method, the dipping method, the vacuum evaporation method, and the sputtering technique can be applied.

Among the above-mentioned materials of the electroconductive film 4, PdO is a preferable material because the following advantages can be cited: (1) PdO can be easily formed into a film-like shape by baking a film containing an organic Pd compound in the atmosphere; (2) because PdO is a semiconductor, PdO has a relatively low electric conductivity and has a wide process margin of the film thickness for obtaining the sheet resistance value in the range mentioned above; (3) because PdO can be easily made to be metal Pd by being reduced after forming the gap 5, which will be described later, the film resistance of the electroconductive film 4 after forming the gap 5 therein is easily decreased, and a heat resisting property is also improved, and the like.

Incidentally, the electrodes 2 and 3 mentioned above are for supplying a voltage to the electroconductive film 4 stably. Consequently, as long as the voltage can be stably supplied to the electroconductive film 4, the electrodes 2 and 3 are not necessarily needed. That is, the electroconductive film 4 can also function as the electrodes 2 and 3. In that case, the electrodes 2 and 3 mentioned above are omissible.

(Step 3)

Figure 3C:
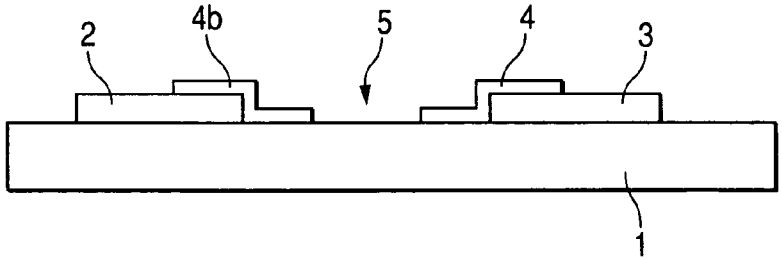

Successively, a second gap 5 is formed in the electroconductive film 4 (FIG. 3C).

The forming method of the second gap 5 can adopt various techniques such as a photolithographic method, a lithographic method using an electron beam, and a working method using a focused ion beam (FIB). Here, a method forming the gap 5 by passing an electric current through the electroconductive film 4 is described.

The method for forming the gap 5 by passing an electric current through the electroconductive film 4 is referred to as a "forming step". The method is a technique of, for example, passing an electric current through the electroconductive film 4 by applying a voltage between the electrodes 2 and 3 using a not shown voltage source (a pulse generator or a voltage pulse generator) to form the second gap 5 in a part of the electroconductive film 4 using the Joule heat generated by the electric current flowing through the electroconductive film 4.

Figure 4A:
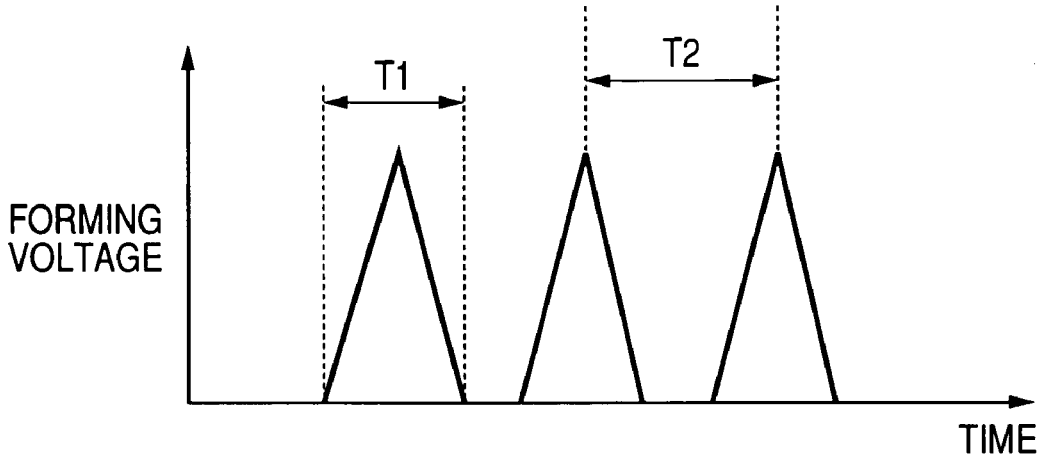
FIGS. 4A and 4B are views illustrating pulse waveforms usable at a "forming step;"
Figure 4B:
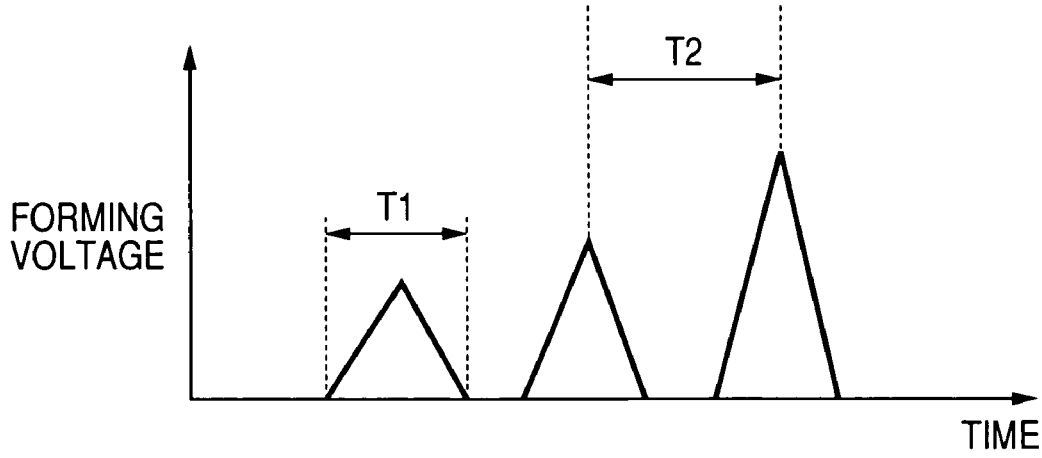

It is preferable to perform the "forming step" by applying a pulse voltage repeatedly (by applying voltage pulses). The examples of the pulse waveforms usable for the "forming step" are shown in FIGS. 4A and 4B. FIG. 4A shows a case where a pulse having a fixed pulse peak value is repeatedly applied. Moreover, FIG. 4B shows a case where a pulse voltage is repeatedly applied while the pulse peak value thereof is increased gradually.

Reference marks $T_1$ and $T_2$ in FIG. 4A denote a pulse width and a pulse interval, respectively. Normally, the pulse width $T_1$ is set within a range of from 1 μsec to 10 msec, and the pulse interval $T_2$ is set within a range of from 10 μsec to 100 msec. The peak value to be used can be suitably selected according to the form of an electron-emitting device. The "forming step" is performed by applying the pulse voltage repeatedly for, e.g. for the duration of from several seconds to several tens of minutes under such conditions. The pulse shape is not limited to the triangular waveform, and can adopt a desired waveform such as a rectangle waveforme. Reference numerals $T_1$ and $T_2$ shown in FIG. 4B can denote the same ones as those shown in FIG. 4A. The peak value can be gradually increased, for example, by 0.1 V at a time.

The electroconductive film 4 can be divided into a first electroconductive film 4*a* and a second electroconductive film 4*b* at the second gap 5 as a boundary by this step. Incidentally, the first and the second electroconductive films 4*a* and 4*b* may be connected with each other through a minute area in so far as the electron emission characteristics are not seriously influenced.

In case of using a metallic oxide as the electroconductive film 4, it is preferable that the "forming step" is performed under the atmosphere containing a gas having a reducing nature, such as hydrogen, because the gap 5 can be formed during reducing the electroconductive film 4. As a result, the electroconductive film 4 containing the metallic oxide as the main component at the stage of Step 2 turns to the electroconductive films 4*a* and 4*b* containing the metal as the main component after finishing the "forming step", and a portion of the parasitic resistance at the time of driving an electron-emitting device can be decreased. Moreover, a step for reducing the electroconductive films 4*a* and 4*b* completely can also be added.

As for the end of the "forming step", in an interval of the pulse voltages, a voltage of a magnitude of the degree of not destroying or deforming the electroconductive film 4 locally, e.g. a pulse voltage of about 0.1 V, is inserted, and the device current (a current flowing between the electrodes 2 and 3) at that time is measured to obtain the resistance value of the electroconductive film 4. Then, the end of the "forming step" can be set at a point of time when the obtained resistance value shows a resistance of, for example, 1000 times of the resistance before the "forming step".

By the present step, the width of the gap 5 (the interval of the first electroconductive film 4*a* and the second electroconductive film 4*b*) can be formed to be less than 100 nm. Such a gap 5 can be formed by using a high accuracy patterning method such as the above-mentioned lithographic method using an electron beam or the working method using a focused ion beam (FIB) without performing the "forming step". However, for forming the gap 5 simply and for a short time, it is preferable to use the "forming step".

(Step 4)

Figure 3D:
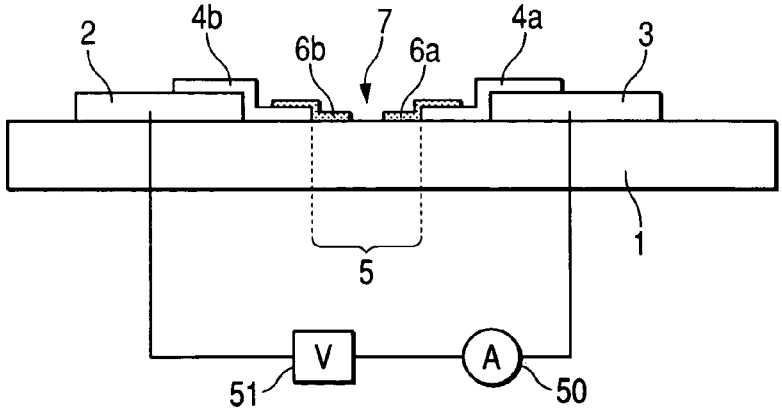

Next, the processing called as "activation step", which is a remarkable feature of the present invention, is performed. In FIG. 3D, a case where carbon films 6*a* and 6*b* are formed on the first and the second electroconductive films (4*a* and 4*b*) in the neighborhood of the gap 5, and formed on the substrate 1 in the gap 5 by the "activation step" is shown. A first gap 7 is formed between the carbon film 6*a* and the carbon film 6*b*. Incidentally, in the present invention, the films (6*a* and 6*b*) formed on the substrate 1 in the gap 5 and on the first and the second electroconductive films 4*a* and 4*b* in the neighborhood of the gap 5 at the "activation step" are not limited to the carbon films, but may be metal or semiconductor films. Moreover, each of the "carbon films", the "metal films", and the "semiconductor films" is not limited to those which consist of only the carbon, the metal, or the semiconductor, respectively. That is, the "carbon films" sometimes may contain the metals and the semiconductors.

The "activation step" in the present invention can be performed by repeatedly applying a voltage (voltage pulse) between the first electroconductive film 4*a* and the second electroconductive film 4*b* (between the first electrode 2 and the second electrode 3) in the atmosphere including a gas containing carbon while controlling the voltage outputted from a voltage source (a pulse generator or a voltage pulse generator) 51 so that a value $\beta_{effect}$, which will be described later in detail, becomes a desired value. By controlling (adjusting) the output voltage so that the value $\beta_{effect}$ becomes the desired value in such a way, it is possible to control (adjust) an effective voltage V' effectively applied to the gap 7 during the "activation step." Incidentally, the carbon films 6*a* and 6*b* in the present invention do not limited to ones consisting of only carbon, but may be ones containing other elements (for example, a metal or semiconductor). Consequently, the "carbon film" is synonymous with "the film containing carbon." Then, in order to obtain a more stable electron emission characteristic, the carbon films 6*a* and 6*b* are preferably the films containing carbon as their main components. Moreover, although it is preferable that the carbon films 6*a* and 6*b* are ones having a graphite structure, the carbon films 6*a* and 6*b* may be amorphous carbon films. Incidentally, the "graphite structure" here may be a structure including many microcrystals of the graphite of the order of a nanosize. Moreover, by changing the gas containing the carbon to a gas containing a metal (such as an organometallic gas), the films 6*a* and 6*b* containing the metal as their main bodies can be also formed in the gap 5 on the substrate 1 and on the first and the second electroconductive films 4*a* and 4*b* in the neighborhood of the gap 5. Consequently, the "activation step" of the present invention can be applied not only to the case where the "carbon films" mentioned above are formed, but also to the case where metal containing films" are formed. Moreover, the metal containing films are not limited also to ones consisting of only metals, but may be ones containing other elements.

To put it concretely, the "activation step" can be executed as follows: the voltage source 51 generating a pulse voltage is connected to the first electrode 2 and the second electrode 3; a preset voltage V is generated by the voltage source 51; and the pulse voltage is repeatedly applied between the first electrode 2 and the second electrode 3 in the gas containing carbon (FIG. 3D).

Incidentally, the first gap 7 is typically arranged in the inside of the second gap 5, and the width of the first gap 7 is narrower than that of the second gap 5. Incidentally, the width of the first gap 7 (the interval between the first carbon film 6*a* and the second carbon film 6*b*) is 50 nm or less, and in order to realize a stable electron emission by a low drive voltage, it is preferable that the gap 7 is practically within a range of from 3 nm to 10 nm. Moreover, although the first carbon film 6*a* and the second carbon film 6*b* are shown in the state of being separated from each other completely in FIGS. 2A and 2B, when the electron emission characteristics are not so much influenced even if the first and the second carbon films 6*a* and 6*b* are not separated from each other completely, the first and the second carbon films 6*a* and 6*b* may be connected to each other in a minute area. For this reason, the carbon films 6*a* and 6*b* formed in the "activation step" may be expressed as "carbon film equipped with the first gap 7" or "carbon film having the first gap 7". Similarly, when the "activation step" is performed in the atmosphere including the gap containing the metal, the carbon films 6*a* and 6*b* may be also expressed as "metal containing film equipped with the first gap 7" or "metal containing film having the first gap 7".

Incidentally, it is considerable that carbon film are gradually deposited to form the carbon film equipped with the gap 7 the ultimate width of which is provided in the "activation step". Consequently, it is conceivable that the shapes of the carbon films 6*a* and 6*b* and the shape (width) of the first gap 7 at the start point of time of the "activation step" also basically differ from those at the endpoint of time of the "activation step."

The atmosphere in the "activation step" for forming the carbon films (6*a* and 6*b*) can be formed by exhausting the inside of the vacuum chamber using, for example, an oil diffusion pump or a rotary pump, and by using the organic gas remaining in the chamber. Alternatively, the atmosphere in the "activation step" can be also formed by introducing a suitable gas containing carbon into the inside of the chamber (in the vacuum) after fully exhausting the inside of the vacuum chamber once by an ion pump or the like. Because the preferable pressure of the gas containing carbon in the "activation step" changes according to the application form of the electron-emitting device, the shape of the vacuum chamber, the kind of the gas containing carbon, and the like, the pressure of the preferable gas containing carbon is suitably set.

As the gas containing carbon, a carbon compound gas can be used. As the carbon compound, an organic material is preferably used. As the organic material, there can be cited aliphatic hydrocarbons such as alkane, alkene and alkyne; aromatic hydrocarbons; alcohols; aldehydes; ketones; amines; organic acids such as phenol, carvone and sulfonic acid, and the like. To put it more concretely, there can be used saturation hydrocarbons expressed by $C_nH_{2n+2}$ such as methane, ethane and propane; unsaturated hydrocarbon expressed by composition formulae such as $C_nH_{2n}$ and the like such as ethylene and propylene; benzene; toluene; methanol; ethanol; formaldehyde; acetaldehyde; acetone; methyl ethyl ketone; methylamine; ethylamine; phenol; formic acid; acetic acid; propionic acid; and the like; and mixtures of them.

One characteristic of the present invention is, as described above, to control (adjust) the voltage V outputted from the voltage source 51 in order that the value $\beta_{effect}$, which will be described later, may be a desired value in the "activation step." As a result, the effective voltage V' effectively applied to the first gap 7 during the "activation step" is controlled (adjusted).

Hereinafter, the premise and the point of view of the control method in the "activation step" of the present invention are described using FIGS. 7, 8A-8C, and 12.

FIGS. 7 and 8A-8C show the examples of the pulses (voltage pulses) which are made to be generated from the voltage source (a pulse generator or a voltage pulse generator) 51 in the "activation step" of the present invention. Incidentally, the waveforms and the kinds of the pulses which are made to be generated from the voltage source 51 in the "activation step" are not limited to these ones.

Figure 7:
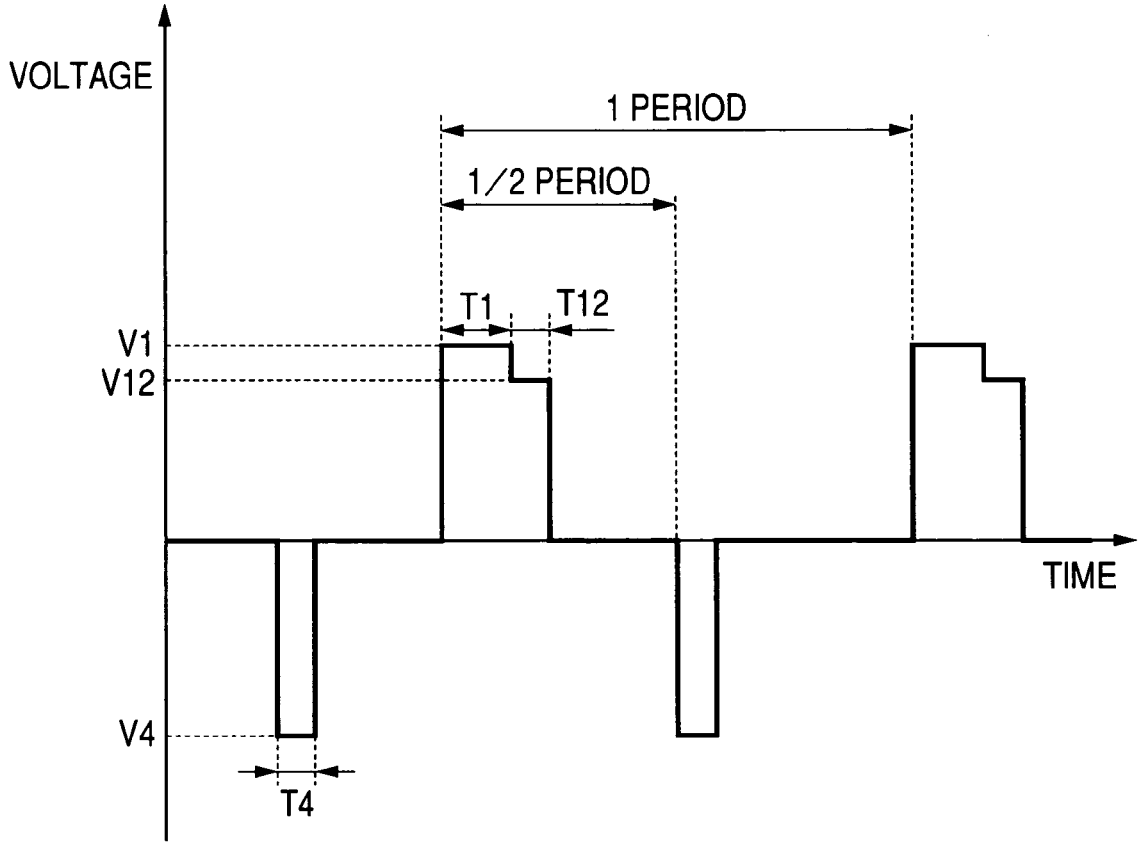
FIG. 7 is a view for illustrating an example of the waveform of pulse voltages usable at the "activation step" of the present invention.
Figure 8A:
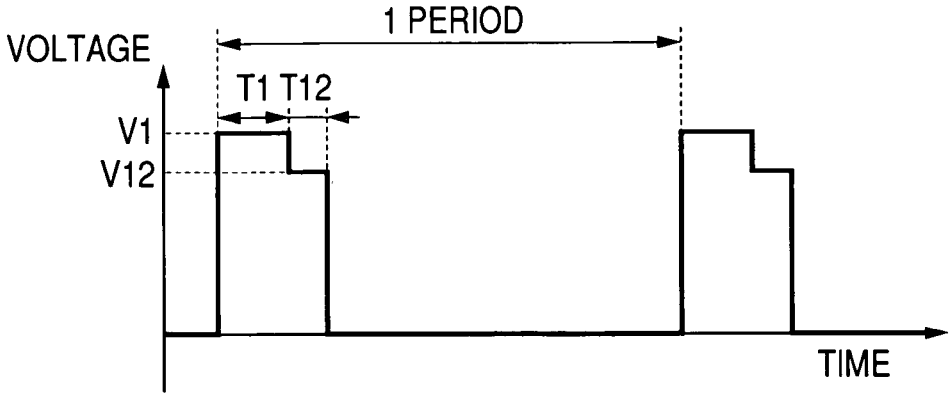
FIGS. 8A, 8B, and 8C are schematic diagrams showing examples of waveforms of pulse voltages usable at the "activation step" of the present invention.
Figure 8B:
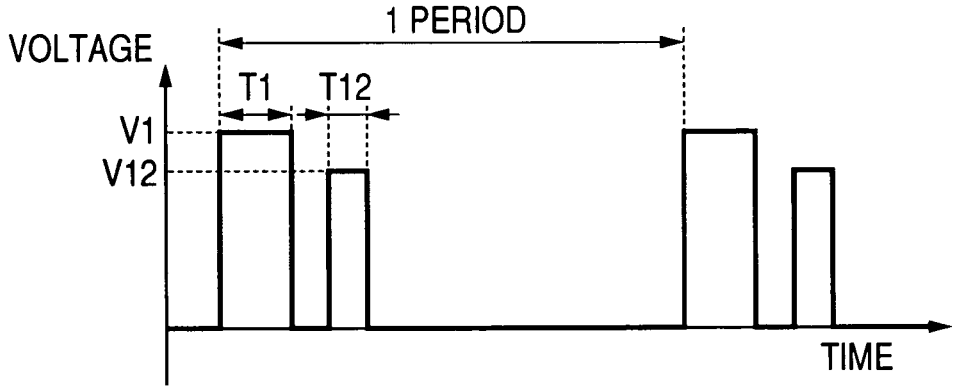
Figure 8C:
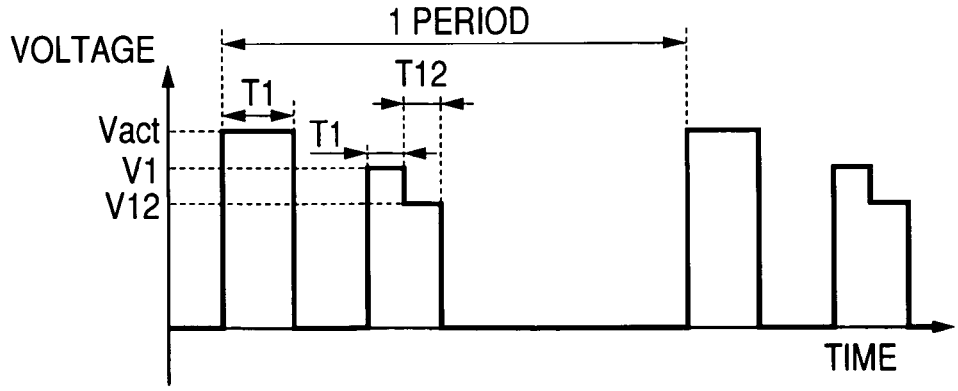

FIG. 8A shows an example of the case of repeatedly outputting a stepwise pulse, which has two different voltages $V_1$ and $V_{12}$ in one pulse, from the voltage source 51. FIG. 7 shows an example of adding a voltage $V_4$ having an inverted polarity of the voltage $V_1$ to each pulse of FIG. 8A. Moreover, FIG. 8B shows an example of the case where the voltages $V_1$ and $V_{12}$ are composed of two independent pulses (voltage pulses). The case is that two pulses are made to be one set, and that the set is repeatedly outputted from the voltage source 51. Moreover, although FIG. 8C will be described later in detail, FIG. 8C shows an example of the case of repeatedly outputting the pulses having different three voltages $V_1$, $V_{12}$, and $V_{act}$ from the voltage source 51. In FIGS. 7, 8B, and 8C, the cases of repeatedly outputting two kinds of pulses having different waveforms from each other from the voltage source 51 are shown. However, in the "activation step" of the present invention, the pulses outputted from the voltage source 51 may be three or more kinds of pulses having different waveforms from one another. Incidentally, although FIG. 8A shows the stepwise pulses each having two voltages $V_1$ and $V_{12}$, the stepwise pulse may be one having three or more different voltages $V_1$, $V_{12}$, $V_{13}$ . . . .

Incidentally, it is supposed that the voltage V1 is referred to as a "first set voltage" generated from the voltage source 51 and the voltage $V_{12}$ is referred to as a "second set voltage" generated from the voltage source 51 in each example of FIGS. 7, 8A-8C. It is necessary that the "first set voltage" and the "second set voltage" have the same polarity. That is, in the example of FIG. 7, the voltage $V_4$ is neither equivalent to the "first set voltage" nor the "second set voltage".

Then, in the controlling (adjusting) of the value $\beta_{effect}$, which is a feature of the present invention and will be described later, it is necessary to output the pulses having voltages which are at least different from each other (the first set voltage $V_1$ and the second set voltage $V_{12}$) as shown in FIGS. 7 and 8A-8C from the voltage source 51. Incidentally, it is preferable that the polarities of the first set voltage $V_1$ and the second set voltage $V_{12}$ are made to be the same ones as that of a drive voltage applied to the electrodes 2 and 3 when electrons are emitted at the time of the drive of the electron-emitting device formed by the manufacturing method of the present invention.

Incidentally, as shown in FIG. 8C, when a pulse having a voltage higher than the first set voltage $V_1$ and the second set voltage $V_{12}$ from the voltage source 51, it is conceivable that the shape of the carbon films 6*a* and 6*b* formed at the "activation step" and the width of the gap 7 (the interval between the first carbon film 6*a* and the second carbon film 6*b*) are more strongly influenced by the pulse having the higher voltage than by the set voltages $V_1$ and $V_{12}$.

Accordingly, in the present invention, the highest voltage among the voltages included in the pulses outputted from the voltage source 51 in the "activation step" is referred to as a voltage "$V_{act}$." Incidentally, because the set voltage $V_1$ is the highest voltage among the voltages included in the pulses outputted from the voltage source 51 in FIGS. 7, 8A and 8B, the set voltage $V_1$ is equivalent to the voltage "$V_{act}$." However, when the set voltage $V_{12}$ is higher than the set voltage $V_1$, the set voltage $V_{12}$ is equivalent to the voltage $V_{act}$. Incidentally, in the example of FIG. 7, the voltage being the maximum of the minus polarity is the voltage $V_4$. Consequently, in the example of FIG. 7, the set voltages $V_1$ and $V_4$ are equivalent to the voltage $V_{act}$.

Accordingly, in the "activation step" of the present invention, as shown in FIG. 8C, it is also possible to separate the pulse (the pulse containing the voltage "$V_{act}$") which mainly takes charge of deposition of the carbon films 6*a* and 6*b* and the pulse (the pulse containing the first set voltage $V_1$ and the second set voltage $V_{12}$) for calculating the value $\beta_{effect}$, which will be described later. In such a case, a method can be adopted in which the pulse for calculating the value $\beta_{effect}$ is outputted from the voltage source 51 at the desired timing of calculating the value $\beta_{effect}$ while outputting the pulse mainly taking charge of the deposition of the carbon films 6*a* and 6*b* from the voltage source (a pulse generator or a voltage pulse generator) 51 periodically. Moreover, in the "activation step" of the present invention, as shown in FIGS. 7 and 8A, it is also possible to adopt a method of using the pulse mainly taking charge of the deposition of the carbon films 6*a* and 6*b* also as the first set voltage $V_1$ described above, and of making the pulse taking charge of the deposition of the carbon films 6*a* and 6*b* include the second set voltage $V_{12}$ necessary for calculating the value $\beta_{effect}$ (of using the stepwise pulse as shown in FIGS. 7 and 8A). Alternatively, as shown in FIG. 8B, it is also possible to adopt a method of using the pulse taking charge of the deposition of the carbon films 6*a* and 6*b* also as the first set voltage $V_1$ described above, and of separating the second set voltage $V_{12}$ necessary for calculating the value $\beta_{effect}$ from the pulse taking charge of the deposition of the carbon films 6*a* and 6*b* to output the voltage from the voltage source 51.

Moreover, although the voltages outputted from the voltage sources (a pulse generator or a voltage pulse generator) 51 are fixed in the examples shown in FIGS. 7 and 8A-8C, it is also possible to raise (decrease) the voltage outputted from the voltage source 51 as time elapses also in the "activation step", for example, as the example of the pulse described using FIG. 4B in the "forming step". In such a case, the voltage $V_{act}$ rises as time elapses.

Moreover, in the case where the pulses of the first set voltage $V_1$ and the second set voltage $V_{12}$ are separated as shown in FIG. 8B, if the period during which no voltages are outputted between the pulse of the first set voltage $V_1$ and the pulse of the second set voltage $V_{12}$ is lengthened, an error may arise in calculation of the voltage $\beta_{effect}$, which will be described later. Accordingly, it is desired to shorten sufficiently the period during which no voltages are substantially outputted. Incidentally, although "the sufficiently short period" here is suitably set because it depends on the kind of the gas containing carbon used in the "activation step" and the partial pressure of the gas containing carbon, "the sufficiently short period" indicates 10 msec or less for practical purposes. Consequently, in the case where the pulses of the first set voltage $V_1$ and the second set voltage $V_{12}$ are separated as shown in FIG. 8B, and in the case where the pulses of the voltage $V_{act}$ and the first set voltage $V_1$ are separated as shown in FIG. 8C, it is preferable to set the intervals of the pulses to be 10 msec or less typically. In the case where the intervals of the pulses are out of the sufficiently short period, a new carbon compound or the like deposits in the gap 7 to change the shape of the gap 7. Consequently, the conditions measured by the first set voltage $V_1$ and the conditions measured by the second set voltage $V_{12}$ become different from each other. Thus, it is gathered that there is the possibility of arising an error in the calculation of the value $\beta_{effect}$, which will be described later.

Consequently, preferably, as shown in FIGS. 7, 8A, and 8C, a stepwise pulse, in which the first set voltage $V_1$ and the second set voltage $V_{12}$ are included in one pulse, is used. Incidentally, because there is a period (an interval) during which no voltages are outputted between the voltage $V_{act}$ and the first set voltage $V_1$ in the case of FIG. 8C, in this case also it is desired that the period during which no voltages are outputted is sufficiently shortened (the period (interval) is typically set to be 10 or less msec). Accordingly, it is preferable to use the pulse shapes shown in FIG. 7 or 8A. Because the voltage $V_4$, having the different polarity, is outputted from the voltage source (a pulse generator or a voltage pulse generator) 51 in case of the waveform shown in FIG. 7, the sufficient amounts of carbon films 6*a* and 6*b* can be formed. Consequently, the deterioration of the electron emission characteristic is less, and the good electron emission characteristic can be obtained. Therefore, the waveform shown in FIG. 7 is preferable. Incidentally, it is not necessary to make the absolute value of the voltage $V_4$ equal to the absolute value of the first set voltage $V_1$ or the absolute value of the second set voltage $V_{12}$.

Moreover, at least the absolute value of the voltage equivalent to the voltage $V_{act}$ among the voltages outputted from the voltage source (a pulse generator or a voltage pulse generator) 51 is set to be within a range of from 15 V to 60 V for practical purposes. And then, preferably, the absolute value of the voltage $V_{act}$ becomes higher than the absolute value of the voltage outputted from the voltage source 51 at the "forming step" described above.

Moreover, a current measured as a current flowing between the first electroconductive film 4*a* and the second electroconductive film 4*b* (the current can be paraphrased to "the current flowing between the electrodes 2 and 3" or "the current flowing through the gap 7") according to the first set voltage $V_1$ when the first set voltage $V_1$ is generated from the pulse generator 51 is supposed to be expressed as a first current described as the first measured current $I_1$. Moreover, similarly, a current measured as the value of a current flowing between the first electroconductive film 4*a* and the second electroconductive film 4*b* according to the second set voltage $V_{12}$ when the second set voltage $V_{12}$ is generated from the voltage source 51 is supposed to be expressed as a second measured current $I_{12}$.

Then, a voltage effectively applied to the gap 7 by generating the first set voltage $V_1$ from the voltage pulse generator 51 is supposed to be expressed as an effective voltage $V_1'$. Moreover, similarly, a voltage effectively applied to the gap 7 (between the end of the first carbon film 6*a* and the end of the second carbon film 6*b*) by generating the second set voltage $V_{12}$ from the voltage pulse generator 51 is supposed to be expressed as an effective voltage $V_{12}'$. Incidentally, because the carbon films 6*a* and 6*b* are sometimes hardly deposited at the extremely initial stage of the "activation step", the first gap 7 can be considered to be substantially replaced with the second gap 5 at such an initial stage.

The effective voltages $V_1'$ and $V_{12}'$ effectively applied to the gap 7 become lower than the set voltages $V_1$ and $V_{12}$ outputted from the voltage source (a pulse generator or a voltage pulse generator) 51. As this reason, because wirings, the electrodes 2 and 3, the electroconductive films 4*a* and 4*b* exist between the voltage source 51 and the gap 7, voltage drops owing to the resistance can be cited. In particular, because the electroconductive films 4*a* and 4*b* are very thin films as described pertaining to Step 2, it is conceivable that the changes of their shapes are caused by the currents, the voltages or the like applied during the "activation step" and the resistance values of the electroconductive films 4*a* and 4*b* change during the "activation step." Then, if the effective voltages during the "activation step" can be controlled (adjusted) to be a desired value, the reproducibility of the electron emission characteristic of the electron-emitting device can be improved, and consequently when an electron source composed of many electron-emitting devices is formed, an electron source having high uniformity can be obtained.

Figure 1:
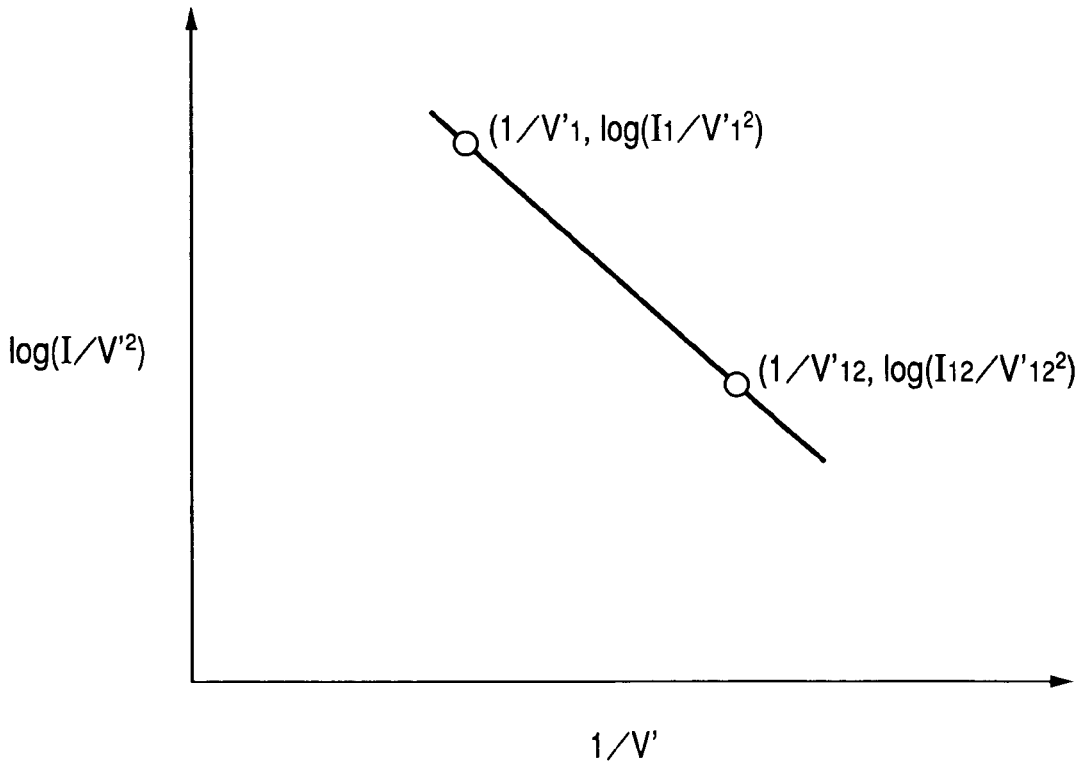
FIG. 1 is a graph illustrating the present invention.

In FIG. 1, using the effective voltages V' ($V_1'$, $V_{12}'$) and the measured currents I ($I_1$, $I_{12}$) mentioned above, the inverse number of the effective voltage V' is written in the abscissa axis, and the logarithmic value of the value of a result of the division of the measured currents I by the square of the effective voltage V' is written in the ordinate axis.

When the inclination of the straight line passing two points in FIG. 1 is considered, the inclination is "−B/β" in the following type (3).

$$I=A\times(\beta V')^2\times\exp(-B/(\beta V')) \tag{3}$$

Here, I denotes the measured currents $I_1$ and $I_{12}$, V' denotes the effective voltages $V_1'$ and $V_{12}'$, and A and B are constants depending on the material in the neighborhood of the gap 7 and an emission area. β is a parameter depending on the shape in the neighborhood of the gap 7, and the product of the effective voltage V' and β becomes electric field strength applied to the gap 7. Because B is a constant, it is possible that the inclination in FIG. 1 is proportional to "−1/β" after all. Because the product of the effective voltage V' and β becomes the electric field strength, in the "activation step", it is conceivable that the condition that the electric field strength is substantially constant is satisfied in the state in which the voltage "$V_{act}$" mentioned above is repeatedly outputted from the voltage source 51 at a sufficiently short interval. Consequently, under such a condition, if either value of the effective voltage V' and β is determined, the other value is also determined.

Accordingly, the effective voltage V' applied to the gap 7 during the "activation step" is controllable as a result by controlling (adjusting) the voltages outputted from the voltage source 51 (such as the first set voltage $V_1$, the second set voltage $V_{12}$, the voltage $V_{act}$, and the like) in order that the β may be a desired value. Consequently, because the control can be made to be more simple, the case of using the first set voltage $V_1$ as the voltage $V_{act}$ as shown in FIGS. 7, 8A and 8B is more preferable than the case of separating the first set voltage $V_1$ from the voltage $V_{act}$ as shown in FIG. 8C, as the waveform outputted form the voltage source 51.

Incidentally, if the value $\beta_{effect}$ is supposed to be written as $\beta_{effect}=\beta/B$, because the value $\beta_{effect}$ is proportional to β, it is known that the effective voltage V' applied to the gap 7 can be controlled by controlling the value $\beta_{effect}$. By the way, as described above, because the inclination of the straight line passing the two points of FIG. 1 is expressed by "−B/β", the value $\beta_{effect}$ can be calculated from the inclination of the straight line passing the two points of FIG. 1. That is, if the value $\beta_{effect}$ is written and shown, the value $\beta_{effect}$ becomes the following equation (1).

$$\begin{aligned}\beta_{effect} &= -1/\{[\ln(I_1/V_1'^2)-\ln(I_{12}/V_{12}'^2)]/(1/V_1'-1/V_{12}')\} \\ &= (1/V_1'-1/V_{12}')/\{\ln(I_{12}/V_{12}'^2)-\ln(I_1/V_1'^2)\}\end{aligned} \tag{1}$$

Accordingly, the "activation step" in the present invention can control (adjust) the effective voltage V' (such as the voltages $V_1'$ and $V_{12}'$) applied to the gap 7 as a result of calculating the value $\beta_{effect}$ and of controlling the voltages outputted from the voltage source 51 (such as the first set voltage $V_1$ and the second set voltage $V_{12}$) in order that the value $\beta_{effect}$ may be a desired value.

By the way, in order to calculate the value $\beta_{effect}$ from the equation (1), it is necessary to calculate the effective voltages V' ($V_1'$, $V_{12}'$) beforehand.

Accordingly, the relations among the first set voltage $V_1$, the effective voltage $V_1'$, and the first measured current $I_1$, or the relations among the second set voltage $V_{12}$, the effective voltage $V_{12}'$, and the second measured current $I_{12}$ are arranged.

As mentioned above, the difference between the set voltages V ($V_1$, $V_{12}$) and the effective voltages V' ($V_1'$, $V_{12}'$) can be considered to be caused by a voltage drop by the resistance component connected to the gap 7 in series. Accordingly, if the value of the resistance component is expressed as $R_{unknown}$, then the effective voltages V' ($V_1'$, $V_{12}'$) can be expressed by the following equation (2).

$$\text{effective voltage } V'=\text{set voltages } V-\text{measured current } I\times R_{unknown} \tag{2}$$

That is, the effective voltages V' ($V_1'$, $V_{12}'$) applied to the gap 7 can be presumed from the set voltages V ($V_1$, $V_{12}$) and the measured currents I ($I_1$, $I_{12}$) using the value $R_{unknown}$ as a parameter. Incidentally, the resistance expressed by the value $R_{unknown}$ is one between the voltage source 51 and the gap 7 such as the resistance of wirings, the resistance of electrodes 2 and 3, the resistance of the electroconductive films 4*a* and 4*b*.

In the resistance, especially the resistance of the electroconductive films 4*a* and 4*b* are not always constant during the "activation step." That is, the resistance of the electroconductive films 4*a* and 4*b* may change during the "activation step."

Also in such a case, the present invention can presume the effective voltage by setting the value $R_{unknown}$ as a variable when the value $\beta_{effect}$ is controlled (adjusted).

An example of the more concrete control method in the "activation step" of the present invention is described with reference to FIGS. 3A-3D and the flowchart of FIG. 12 based on the above contents.

First, on starting the "activation step", a target value $\beta_{set}$ of the value $\beta_{effect}$ controlled in the "activation step" is determined beforehand. By determining the target value $\beta_{set}$, a target effective voltage V' is also determined. Moreover, at this time, the initial value of the value $R_{unknown}$ of the resistance component connected to the gap 7 is also determined.

(Step 1)

A pulse (voltage pulse) having set voltages is outputted from the voltage source (the pulse generator or the voltage pulse generatoe) 51.

The pulse is a kind of pulse or a plurality of kinds of pulses which have mutually different voltages (the first set voltage $V_1$, the second set voltage $V_{12}$) as mentioned above with reference to FIGS. 7 and 8A-8C. As the voltages, a large number of voltages having different magnitudes such as a third set voltage $V_{13}$ and a fourth set voltage $V_{14}$ can be further used. By outputting many different voltages, the accuracy of the result of the calculation of the value $\beta_{effect}$ at Step 4 can be increased.

(Step 2)

The measured currents (the first measured current $I_1$ and the second measured current $I_{12}$), which are currents flowing between the electrodes 2 and 3 according to the set voltages (the first set voltage $V_1$ and the second set voltage $V_{12}$) outputted at Step 1, are measured.

Incidentally, if n kinds of voltages are used as the set voltages, the measured currents are also become n kinds of currents. However, a method of selecting desired two kinds of currents among the n kinds of the measured currents may be adopted.

(Step 3)

The effective voltages $V_1'$ and $V_{12}'$ are calculated from the set voltages $V_1$ and $V_{12}$ and the measured currents $I_1$ and $I_{12}$.

In the calculation of the effective voltages $V_1'$ and $V_{12}'$, the equation (2) mentioned above is used. As the initial value of the value $R_{unknown}$ in the equation (2), for example, the sum $R_1$ of the resistance of wirings, the resistance of the electrodes 2 and 3, and the gathered value of the resistance of the electroconductive films 4*a* and 4*b* may be set.

(Step 4)

The value $\beta_{effect}$ is calculated based on the effective voltages $V_1'$ and $V_{12}'$ calculated at Step 3 and the measured currents $I_1$ and $I_{12}$.

In the calculation of the value $\beta_{effect}$, the equation (1) mentioned above is used.

(Step 5)

The value $\beta_{effect}$ calculated at Step 4 is compared with the target value $\beta_{set}$ determined beforehand. When there is a difference between the values $\beta_{effect}$ and $\beta_{set}$, the processing advances to Step 6. When there are no differences, the processing advances to Step 9.

Incidentally, in the present invention, there is a case where the difference between the values $\beta_{effect}$ and $\beta_{set}$ may be within a preset range in some specifications of the electron-emitting devices which are desired to be finally obtained even if the value $\beta_{effect}$ is not completely equal to the value $\beta_{set}$. Although it is an ideal to make the values $\beta_{effect}$ and $\beta_{set}$ to be mutually equal completely, it is not preferable that the complete accordance takes time too much or raise a cost. Accordingly, the processing can also advance to Step 9 at a point of time when the difference between the values $\beta_{effect}$ and $\beta_{set}$ is confirmed to be within an allowable range at Step 5.

(Step 6)

When the value $\beta_{effect}$ is larger than the value $\beta_{set}$, the processing advances to Step 7A. When the value $\beta_{effect}$ is smaller than the value $\beta_{set}$, the processing advances to Step 7B.

(Step 7A, 7B)

When the value $\beta_{effect}$ is larger than the value $\beta_{set}$, the cause thereof is that the value $R_{unknown}$ adopted at Step 4 is small. Accordingly, a correction value $\Delta R$ is added to the value $R_{unknown}$ adopted at Step 4 to increase the value $R_{unknown}$ (Step 7A). On the other hand, when the value $\beta_{effect}$ is smaller than the value $\beta_{set}$, the cause thereof is that the value $R_{unknown}$ adopted at Step 4 is large. Accordingly, a correction value $\Delta R$ is subtracted from the value $R_{unknown}$ adopted at Step 4 to reduce the value $R_{unknown}$ (step 7B)

Here, a case where the calculated value $\beta_{effect}$ and the value $\beta_{set}$ do not agree is considered. In this case, a case where the effective voltage calculated at Step 3 differs from the target effective voltage is conceivable as a primary factor. Such a case may arise when the influence of a voltage drop is erroneously estimated. Accordingly, it is suitable to vary the set voltage values outputted from the voltage source 51 in order that the calculated value $\beta_{effect}$ and the value $\beta_{set}$ may agree (correspond) with each other, or in order that the calculated value $\beta_{effect}$ and the value $\beta_{set}$ may approach each other. As the method of the varying, a method of varying the value $R_{unknown}$ can be used.

That is, it is suitable to vary the value $R_{unknown}$ in order that the calculated value $\beta_{effect}$ derived from the equation (1) may agree (correspond) with the value $\beta_{set}$, or in order that the difference between the values $\beta_{effect}$ and $\beta_{set}$ may be reduced, and to vary the voltage values in order to compensate the voltage drop expressed by the product of the value $R_{unknown}$ and the current.

By the technique, it is possible to adapt even when the value $R_{unknown}$ has varied. Now, when the initial value of the value $R_{unknown}$ is described as $R_1$, it is judged that the effective voltage is lower than the value of the effective voltage calculated from the equation (2) when the value $\beta_{effect}$ derived from the equation (1) is larger than the value $\beta_{set}$. It is conceivable that the cause of the difference is that the initial value $R_1$ of the value $R_{unknown}$ which has been previously estimated in the equation (2) has been low. Accordingly, it is suitable to change the value $R_{unknown}$ to be the value $R_2$ which is a larger value than the initial value $R_1$. On the contrary, when the value $\beta_{effect}$ derived from the equation (1) is smaller than the value $\beta_{set}$, it is judged that the effective voltage is higher than the value of the effective voltage calculated from the equation (2). It is conceivable that the cause of the difference is that the initial value $R_1$ of the value $R_{unknown}$ which has been previously estimated in the equation (2) has been high. Accordingly, it is suitable to change the value $R_{unknown}$ to be the value $R_3$ which is a smaller value than the initial value $R_1$. Incidentally, the initial value $R_1$ of the value $R_{unknown}$ is set as a value within a range of from 0 Ω to 40 kΩ for practical purposes.

It becomes possible to adjust the set voltages outputted from the voltage source 51 according to such changes. In this case, the correction value $\Delta R$ expressed by $R_2-R_1$ or $R_3-R_1$ can be determined according to, for example, the difference of the values $\beta_{effect}$ and $\beta_{set}$.

(Step 8)

A new set voltage is calculated by assigning a resistance value ($R_2$ or $R_3$) varied at Step 7A or 7B to the equation (2). Then, the new set voltage is used as the set voltage outputted from the voltage source 51, and the processing returns to Step 1 again.

By setting the control steps of from Step 1 to Step 8 as one cycle, the cycle is repeated until the value $\beta_{effect}$ becomes equal to the value $\beta_{set}$, or until the value $\beta_{effect}$ falls within a preset range.

(Step 9)

After confirming that the value $\beta_{effect}$ is equal to the value $\beta_{set}$, or that the value $\beta_{effect}$ falls in the preset range, the outputting of the voltages from the voltage source 51 is stopped.

At the above step, the "activation step" of the present invention can be basically completed.

However, for example, even if the value $\beta_{effect}$ calculated at Step 4 is equal to the value $\beta_{set}$, or even if the value $\beta_{effect}$ falls in the preset range, the emission current Ie and/or the device current If sometimes do not reach the respective desired values.

In such a case, it is preferable to continue repeating the above-mentioned cycle until the emission current Ie and/or the device current If reach the respective desired ones. As a set voltage to be outputted at Step 1 in the succeeding cycle to the electron-emitting device in which the emission current Ie and/or the device current If do not reach the respective desired ones though the value $\beta_{effect}$ is equal to the value $\beta_{set}$ or the value $\beta_{effect}$ falls within the preset range in such a way, a voltage equal to the set voltage outputted at Step 1 in the preceding cycle can be used. If such a cycle is repeated until the emission current Ie and/or the device current If reach the respective desired ones, there is a case where the value $\beta_{effect}$ shifts. In that case, because it is confirmed that the values $\beta_{effect}$ and $\beta_{set}$ are different from each other at Step 5, it is suitable to shift to Step 6 at that point of time. Then, at the point of time when the emission current Ie and/or the device current If reach the respective desired ones and the value $\beta_{effect}$ has become equal to the value $\beta_{set}$ or the value $\beta_{effect}$ has fallen within the preset range, the "activation step" is ended.

Moreover, for example, in the case where the "activation step" is performed to many electron-emitting devices simultaneously, (or in the case where many electron-emitting devices are simultaneously exposed to the atmosphere containing carbon), the "activation step" to all of the electron-emitting devices is not always completed simultaneously. For example, there is a case where in a part of the electron-emitting devices, the time necessary for the value $\beta_{effect}$ to become equal to the value $\beta_{set}$ or the time necessary for the value $\beta_{effect}$ to fall in the preset range is earlier than that of the other electron-emitting devices.

In such a case, it is preferable to continue the above-mentioned cycle to the electron-emitting devices in which the values $\beta_{effect}$ have become equal to the values $\beta_{set}$ or the values $\beta_{effect}$ has fallen within the preset range until the values $\beta_{effect}$ of all of the other electron-emitting devices become equal to the values $\beta_{set}$ or the values $\beta_{effect}$ fall within the preset range. As the set voltage outputted at Step 1 in the succeeding cycle to the electron-emitting device in which the value $\beta_{effect}$ has become equal to the value $\beta_{set}$ or the value $\beta_{effect}$ has fallen within the preset range in such a way, the voltage equal to the set voltage outputted at Step 1 in the preceding cycle can be used. It is needless to say that there is a case where the value $\beta_{effect}$ begins to shift while repeating such a cycle until the values $\beta_{effect}$ of all of the other electron-emitting devices become equal to the values $\beta_{set}$ or the values $\beta_{effect}$ fall within the preset range. In such a case, because it is confirmed at Step 5 that the value βeffect is different from the value βset, it is suitable to shift to Step 6 at that point of time.

Moreover, in the case where the "activation step" is performed to many electron-emitting devices simultaneously (or in the case where many electron-emitting devices are exposed to the atmosphere containing carbon), there is also a case where the time difference in the time of the emission currents Ie and/or the device currents If to reach the respective desired ones, as described above, arises in addition to the case where the time difference of the values βeffect to become equal to the values βset (or to fall within a tolerance) as described above.

Also in this case, by repeating the above-mentioned cycle until the emission currents Ie and/or the device currents If of all of the electron-emitting devices become the respective desired values, it is possible to form electron sources having high uniformity.

By performing the "activation step" described above, the reproducibility in the manufacturing of electron-emitting devices can be improved. Moreover, the values $\beta_{effect}$ can be made to be uniform in a plurality of electron-emitting devices. Consequently, it becomes possible to make the effective voltages V' applied in the "activation step" uniform. As a result, it becomes possible to decrease the dispersion of the electron emission characteristics caused by the differences among the effective voltages V' applied in the "activation step".

Incidentally, in the present invention, there is a case where the value $\beta_{effect}$ is observed to be larger for a while immediately after starting the "activation step" (the initial period of the application of pulse voltages) in the present invention. The cause of this phenomenon is considered to be the fact that the carbon films 6*a* and 6*b* are scarcely deposited or the carbon films 6*a* and 6*b* do not reach to form the width of the first gap 7 (the interval between the first carbon film 6*a* and the second carbon film 6*b*) in the initial period of the "activation step". Consequently, in such a case, for example, it is suitable to use the following control cycle (A) or (B).

Figure 12:
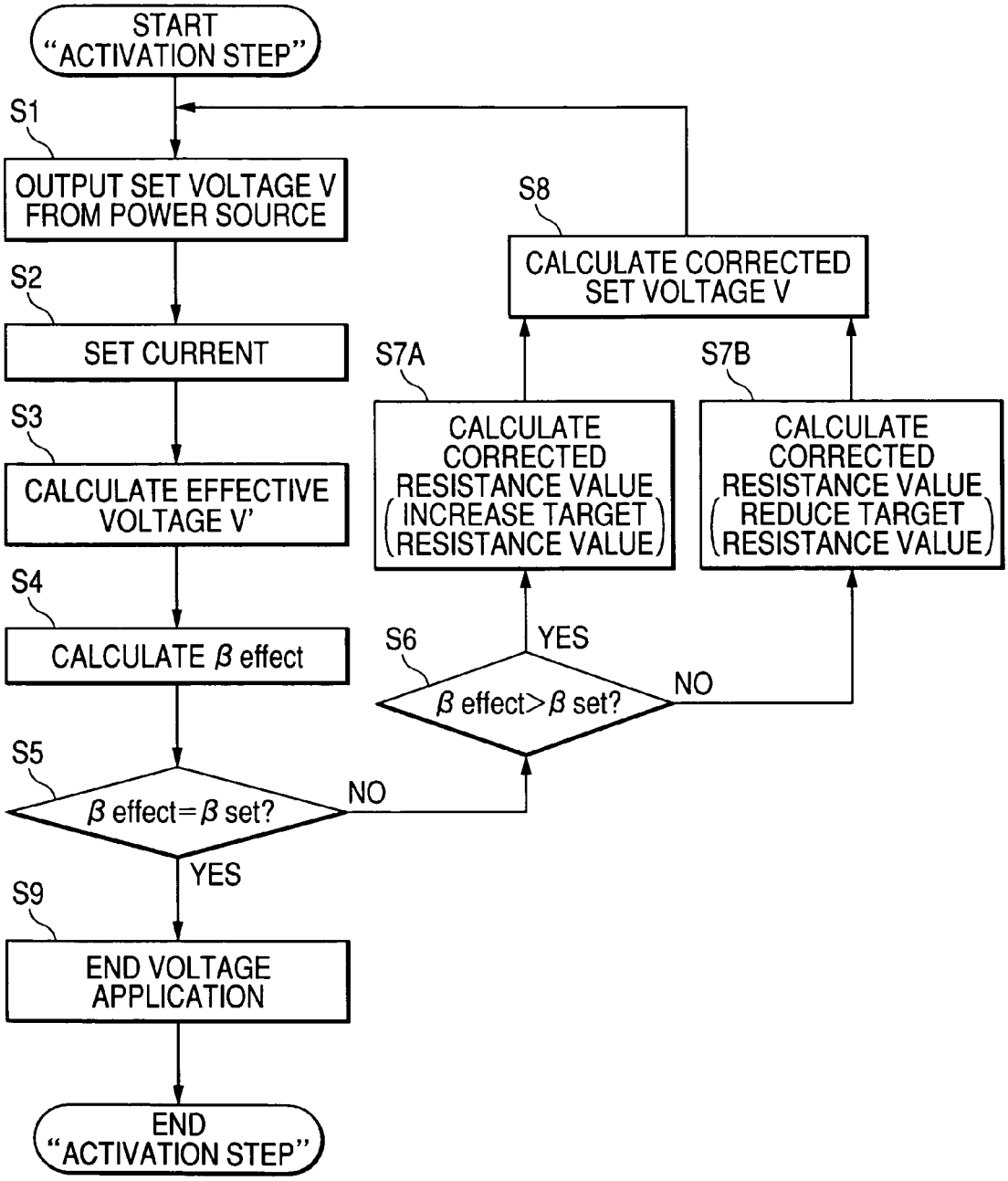
FIG. 12 is a flowchart schematically showing an example of control at the "activation step" of the present invention.

(A) Until the value $\beta_{effect}$ be within a desired range (the range of the value $\beta_{set}$±50% for practical purposes), Steps 1-4 shown in FIG. 12 are repeated. After confirming that the value $\beta_{effect}$ has become within the desired range at Step 4, the processing advances to Step 5 and followers, and starts the control of varying the set voltages in order that the calculated value $\beta_{effect}$ and the value $\beta_{set}$ may agree with each other or the difference between the values $\beta_{effect}$ and $\beta_{set}$ may decrease.

(B) Until the value $\beta_{effect}$ is within the desired range (the range of the value $\beta_{set}$±50% for practical purposes), as the initial value of the value $R_{unknown}$, for example, the control cycle of setting a value $R_1$ gathered from the resistance of wirings, the resistance of the electrodes 2 and 3, the sum of the resistance of the electroconductive films 4*a* and 4*b*, and of adding the amount of voltage drop expressed by the product of the value $R_1$ and the measured currents I ($I_1$ and $I_{12}$) measured at Step 2 to the set voltage is repeated. Then, after confirming the fact that the value $\beta_{effect}$ has become within the desired range at Step 4, the processing advances to Step 5 and followers, and the control of varying the set voltage in order that the calculated value $\beta_{effect}$ and the value $\beta_{set}$ may agree with each other, or in order that the difference between the value $\beta_{effect}$ and the calculated value $\beta_{set}$ may be reduced is started.

Moreover, with regard to the correction method of the value $R_{unknown}$, for example, it is also possible to control the correction value ΔR of the value $R_{unknown}$ as the value obtained by multiplying the value calculated the difference of the values $\beta_{effect}$ and $\beta_{set}$ by a coefficient k ($k\times|\beta_{effect}-\beta_{set}|$). As the value of the coefficient k, it is preferably within a range of from 1 to 100000 both inclusive, more preferably within a range of from 100 to 20000, for practical purposes. When the coefficient k is out of the range, there is a case where the time necessary for the activation step of the present invention becomes extremely long or the value $\beta_{effect}$ does not converge. It is also possible to start the above-mentioned control from the initial period of the "activation step" (the initial period of the application of the pulse voltages) by suitably setting the coefficient k. In such a case, for example, it is possible to deal with such a case by making the correction value AR of the value $R_{unknown}$ to be small by setting the coefficient k to be small at the initial period of the "activation step", and by increasing the value of the coefficient k at a point of time when the "activation step" progresses to some extent.

When it is supposed that a voltage within a range of from 20 V to 30 V is applied to the gap 7 as the effective voltage V', the value $\beta_{set}$ is preferably within a range of 0.00338 to 0.00508 both inclusive for practical purposes.

Moreover, although it is difficult to set the ranges of the set voltages V and the value $R_{unknown}$ independently because the relation of the equation (2) is applied by the values of both of the set voltages V and the value $R_{unknown}$, the effective voltage V' and the measured currents I, for example, the set voltages V are 60 V or less in the above-mentioned range of the effective voltage V'. Moreover, because the first set voltage $V_1$ and the second set voltage $V_{12}$ are different from each other, and in order that the set voltages V satisfy the relation of the equation (3), the set voltages V is 15 V or more. This value is equivalent to the voltage by which about 2% of the measured currents I flowing between the electrodes 2 and 3 which flow when the maximum values of the set voltages V are 20 V.

Moreover, although the range of the initial value $R_1$ of the value $R_{unknown}$ depends on the set voltages V and the measured currents I, when the range for practical purposes is considered, the range is 300 Ω or less when the measured currents I are 100 mA, and the range is 40 kΩ or less when the measured currents I are 1 mA. Moreover, the lower limit of the value $R_1$ can also be set to 0 Ω.

The carbon films 6*a* and 6*b* formed at the "activation step" of the present invention are films containing carbon and/or carbon compounds, and are films containing carbon and/or carbon compounds as the main components for practical purposes.

Here, carbon and carbon compounds are, for example, graphite (the so-called HOPG, PG, and GC are included (HOPG indicates an almost complete crystal structure of graphite; PG indicates graphite having crystal grains of about 20 nm and a slightly confused crystal structure; and GC indicates graphite having crystal grains about 2 nm and a more confused crystal structure)), and amorphous carbon (indicating amorphous carbon and a microcrystal mixture of amorphous carbon and the graphite).

Moreover, the film thicknesses of the carbon films 6*a* and 6*b* are preferably within a range of 200 nm or less, and more preferably within a range of 100 nm or less.

(Step 5)

Next, the electron-emitting device obtained after processed by Steps 1-4 is preferably receives a "stabilization step."

The stabillization step is a step for mainly exhausting the carbon compounds in the vacuum chamber and/or the carbon compounds remaining on the substrate 1 forming electron-emitting devices thereon. The pressure in the vacuum chamber is needed to be decreased as much as possible, and the pressure is preferably $1\times10^{-6}$ Pa or less.

As for the vacuum pumping apparatus for exhausting the vacuum chamber, it is preferably one using no oil lest the oil generated by the apparatus should influence the characteristic of an electron-emitting device formed through Steps 1-4. To put it concretely, the vacuum pumping apparatuses such as a sorption pump and an ion pump can be cited.

When the inside of the vacuum chamber is exhausted, it is preferable to heat the whole vacuum chamber to make it easy to exhaust the organic material molecules attached to the inner wall of the vacuum chamber and to the electron-emitting device. The heating condition in this case is 80° C. or more, and preferably within a range of from 150° C. to 350° C. both inclusive, and it is preferable to process as long as possible.

The atmosphere at the time of the drive of the electron-emitting device after performing the "stabilization step" preferable maintains the atmosphere at the time of the end of the "stabilization step." However, if the organic materials are removed sufficiently, even if the degree of vacuum itself somewhat falls, a sufficient stable characteristic can be maintained. By adopting such a vacuum atmosphere, the deposition of new carbon or new carbon compounds can be restrained, and $H_2O$, $O_2$ or the like attached to the vacuum chamber, the substrate and the like can be removed. As a result, the device current If and the emission current Ie are stabilized.

The basic properties of the electron-emitting device of the present invention obtained through the steps described above are described with reference to FIGS. 5 and 6.

Figure 5:
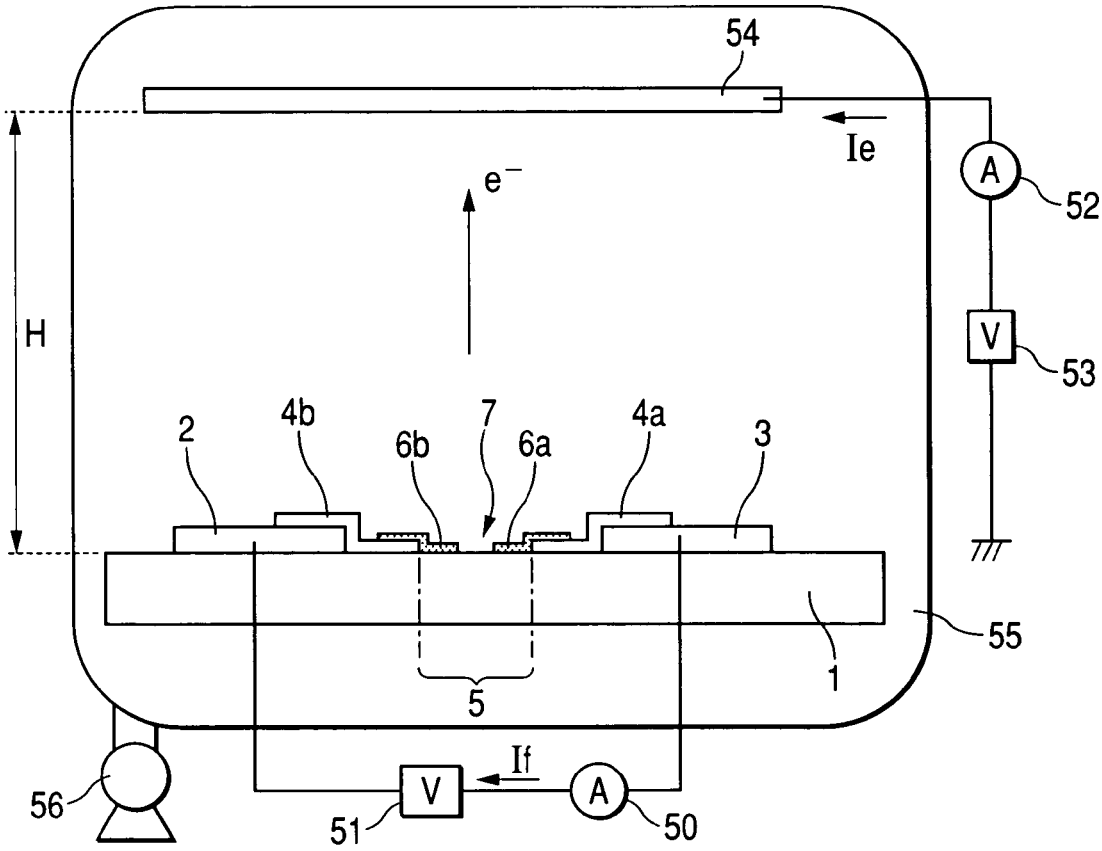
FIG. 5 is a schematic view showing an apparatus for measuring the electron emission characteristic of the electron-emitting device formed by the application of the present invention.

FIG. 5 is a schematic view showing an example of the vacuum processing apparatus, and the vacuum processing apparatus also has the function as a measurement evaluation apparatus. Also in FIG. 5, the same portions as those shown in FIG. 2 are denoted by the same reference marks as those in FIG. 2.

In FIG. 5, a reference numeral 55 denotes a vacuum chamber, and a reference numeral 56 denotes an exhaust pump. The electron-emitting device formed through the above-mentioned Steps 1-5 is arranged in the vacuum chamber 55. The reference numeral 51 denotes the voltage source for applying a device voltage Vf to the electron-emitting device. A reference numeral 50 denotes an ammeter for measuring the device current If flowing between the electrodes 2 and 3. A reference numeral 54 denotes an anode electrode for trapping the emission current Ie emitted form the electron-emitting device. A reference numeral 53 denotes a high-voltage voltage source for applying a voltage to the anode electrode 54. A reference numeral 52 denotes an ammeter for measuring the emission current Ie. The voltage of the anode electrode 53 is preferably within a range of from 1 kV to 20 kV both inclusive, and the distance H between the anode electrode 53 and the electron-emitting device is measured as a range of from 1 mm to 10 mm both inclusive.

In the vacuum chamber 55, equipment necessary for the measurement under a vacuum atmosphere, such as a not shown vacuum meter, is provided, and measurement evaluation under a desired vacuum atmosphere can be performed. The exhaust pump 56 is composed of a normal high vacuum equipment system composed of a turbo-pump and a rotary pump, and a super-high vacuum equipment system composed of an ion pump and the like. The whole vacuum processing apparatus arranging the substrate 1 shown here can be heated by a not shown heater. Consequently, when the vacuum processing apparatus is used, Steps 3-5 described above can be also performed.

Figure 6:
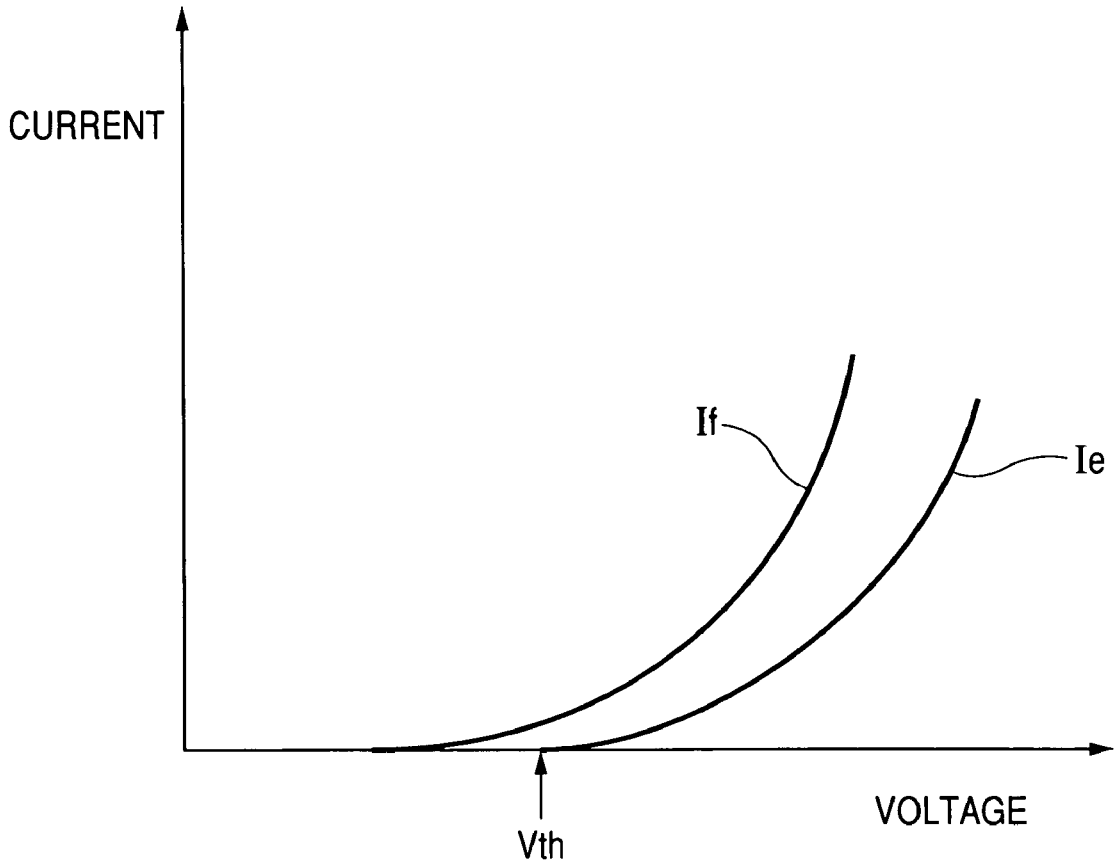
FIG. 6 is a schematic view for illustrating the electron emission characteristic of the electron-emitting device formed by the application of the present invention.

FIG. 6 is a view schematically showing relations between the emission current Ie, the device current If, and the device voltage Vf measured using the vacuum processing apparatus shown in FIG. 5. Because emission current Ie is remarkably small in comparison with the device current If, FIG. 6 is shown using an arbitrary unit. Incidentally, both of the ordinate axis thereof and the abscissa axis thereof are linear scales.

As apparent also from FIG. 6, the electron-emitting device obtained by the manufacturing method of the present invention has three characteristic qualities about the emission current Ie.

That is:

(1) The emission current Ie is rapidly increases when a certain voltage (referred to as a "threshold voltage", which is Vth in FIG. 6) is applied. On the other hand, almost no emission current Ie is detected when the applied voltage is the threshold voltage Vth or less. That is, the electron-emitting device is a nonlinear device having the clear threshold voltage Vth to the emission current Ie;

(2) Because the emission current Ie depends on the device voltage Vf to simply increase, the emission current Ie can be controlled by the device voltage Vf; and (3) The emission charges trapped by the anode electrode 54 depend on the time of applying the device voltage Vf. That is, the amount of electric charges trapped by the anode electrode 54 can be controlled by the time of applying the device voltage Vf.

As can be understood by the above description, the electron-emitting device obtained by the manufacturing method of the present invention can easily control the electron emission characteristic thereof according to an input signal. If this property is used, the electron-emitting device can be applied to many fields such as an electron source, an image display device, and the like which are composed of a plurality of arranged electron-emitting devices.

Incidentally, it is preferable to perform a drive in the same polarity as the polarity by which the effective voltage V' is driven in the electron-emitting device formed by the manufacturing method of the present invention. For example, in the case where the "activation step" is performed using the pulses shown in FIG. 7, the electrode on the side on which the first and the second set voltages $V_1$ and $V_{12}$ are applied among the electrodes 2 and 3 is made to be the electrode to which high potential is applied at the time of a drive. That is, for example, when 0V is applied to the electrode 3 and the positive set voltages $V_1$ and $V_{12}$ are applied to the electrode 2, it is preferable to emit electrons in the state in which the potential of the electrode 2 is made to be higher than that of the electrode 3 at the time of the drive of the electron-emitting device.

Next, an electron source and an image display device each equipped with a plurality of electron-emitting devices which can be created by the manufacturing method of the present invention is described in the following.

Figure 10:
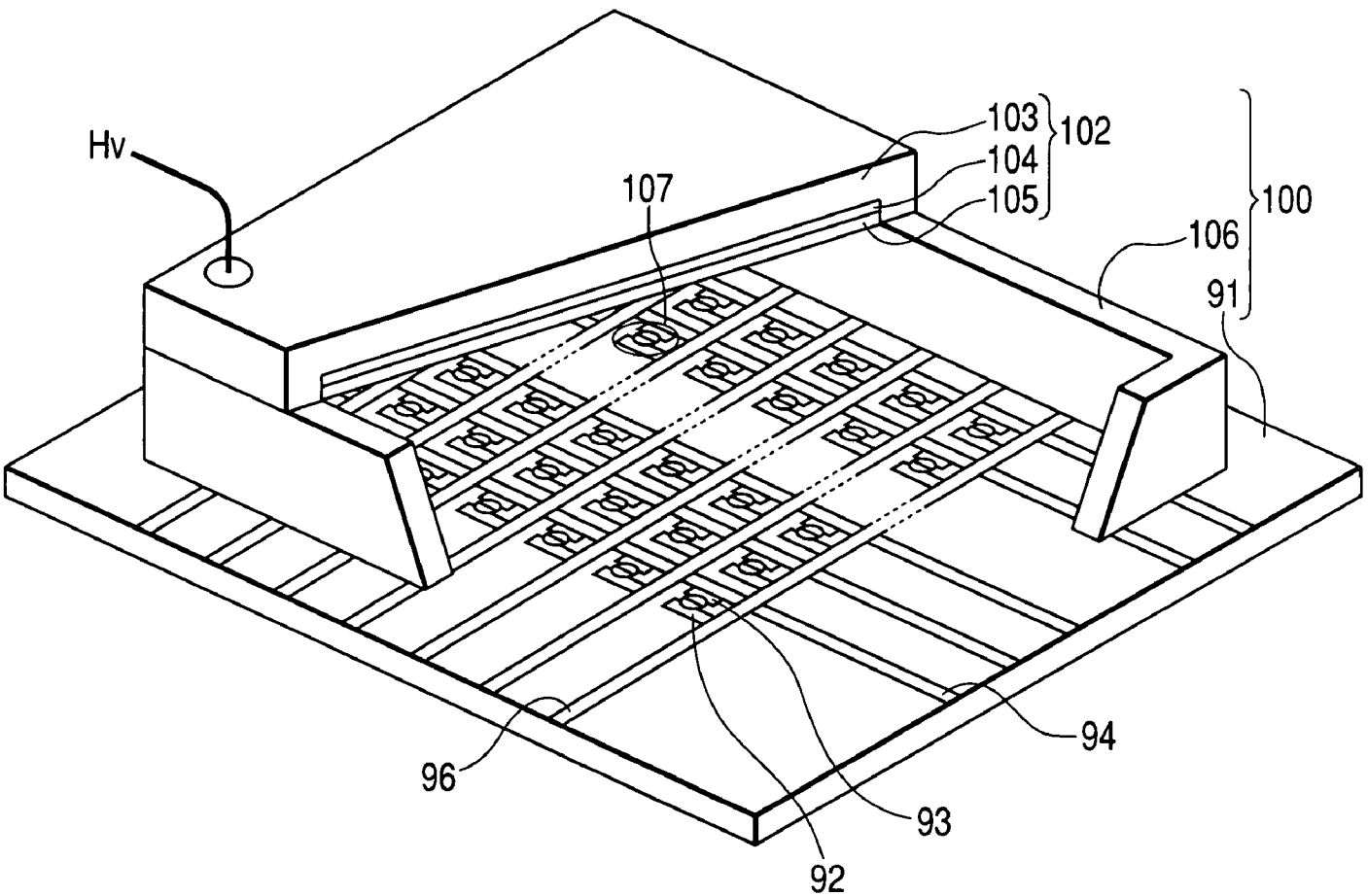
FIG. 10 is a schematic view showing an example of an image display device of the present invention.

FIG. 10 is a perspective view schematically showing an embodiment of an envelope 100 constituting the image display device according to the present invention. Incidentally, FIG. 10 shows the envelope 100 in the state in which a part of the envelope 100 is cut off or omitted in order to make an understanding easy. As shown in FIG. 10, an electron source composed of many electron-emitting devices 107 obtained by the manufacturing method of the present invention is arranged on the rear plate 91. Moreover, a reference numeral 94 denotes a Y-direction wiring. A reference numeral 96 denotes an X-direction wiring. A reference numeral 102 denotes a face plate. A reference numeral 103 denotes a glass substrate. A reference numeral 104 denotes a phosphor layer. A reference numeral 105 denotes a metal back. A reference numeral 106 denotes supporting frame.

Such an envelope 100 can be obtained by performing seal bonding of the face plate 102 and the rear plate 91. And generally, in order to regulate the distance between the face plate 102 and the rear plate 91, the seal bonding is performed with the supporting frame 106 put between them. Moreover, in the case of forming a large-sized envelope, a supporting member called as a spacer is located in the inner part of the envelope 100 to be arranged between the face plate 102 and the rear plate 91.

On the rear plate 91, the Y-direction wiring (lower wiring) 94 connected to one electrode 93 of the electron-emitting device 107 is formed, and the X-direction wiring (upper wiring) 96 is further formed with an insulating layer (not shown) put between them. Incidentally, the X-direction wiring (upper wiring) 96 is arranged in the direction which intersects the Y-direction wiring 94, and is connected to an electrode 92 on the other side through a contact hole (not shown) formed in the insulating layer. Thus, each electron-emitting device 107 is configured to be able to be selectively driven by applying a voltage between the electrodes 92 and 93 through the Y-direction wiring 94 and the X-direction wiring 96. The materials, the film thicknesses, the wiring widths and the like of the Y-direction wiring 94 and the X-direction wiring 96 are suitably set. Moreover, as the examples of the forming method of the Y-direction wiring 94, the X-direction wiring 96, and the insulating layer, the printing method, a combination of the sputtering technique and the photolithography technique, and the like can be used.

Opposed to the rear plate 91, the transparent insulating face plate 102 made of glass or the like is arranged. On the inner surface of the face plate 102, the phosphor layer 104 and the metal back 105 are formed. Incidentally, the metal back 105 is an electroconductive film equivalent to the anode electrode mentioned above. The reference numeral 106 denotes the supporting frame, and is seal-bonded with the rear plate 91 and the face plate 102 with an adhesive such as frit glass to form the envelope 100 the inner part of which is maintained to be hermetic. Incidentally, the interval of the face plate 102 and the rear plate 91 is preferably to be maintained to a value selected in a range of from 1 mm to 10 mm both inclusive.

The internal space of the envelope 100 surrounded by the rear plate 91, the supporting frame 106, and the face plate 102 is held at a vacuum. The vacuum atmosphere can be formed by providing an exhaust pipe in the rear plate 91 or the face plate 102 and seals the exhaust pipe after performing the vacuum pumping of the inside. Moreover, by performing the seal bonding of the supporting frame 106, the rear plate 91 and the face plate 102 in the vacuum chamber, the envelope 100 the inner part of which is maintained to the vacuum can be easily formed without using the exhaust pipe.

For displaying an image, a drive circuit for driving each electron-emitting device 107 is connected to the envelope 100; voltages are applied between the desired electrodes 92 and 93 through the Y-direction wiring 94 and the X-direction wiring 94 to generate electrons from the electron-emitting area; and a high voltage in a range of from 50 kV to 30 kV is applied to the metal back 105, being an anode electrode, from a high voltage terminal Hv to accelerate the electron beams. Thereby, the accelerated electron beams are made to collide with the phosphor layer 104 to display the image.

The phosphor layer 104 can be obtained by arranging phosphors of three primary colors in a desired period when a color display is desired to be performed by the image display device. And it is preferable to arrange a light absorption layer between the phosphors of each color. A typical black member can be used as the light absorption layer. Carbon can be used as the black member.

Moreover, the envelope 100 having a sufficient intensity to the atmospheric pressure can be configured by providing a not shown supporting member called as a spacer between the face plate 102 and the rear plate 91.

Moreover, an information display reproduction apparatus can be constituted using the envelope (a image display device, a display panel) 100 of the present invention described using FIG. 10.

To put it concretely, the information display reproduction apparatus includes a receiving apparatus receiving a broadcast signal such as television broadcasting and a tuner performing the channel selection of the received signal, and outputs at least one piece of image information, character information and sound information included in the signal which has received the channel selection to the envelope (image display device) 100 to display and/or reproducing the information. By this configuration, the information display reproduction apparatus such as a television can be configured. It is needless to say that, when the broadcast signal is encoded, the information display reproduction apparatus of the present invention can also include a decoder. Moreover, a sound signal is outputted to sound reproduction means such as a speaker, which is provided separately, to be synchronously reproduced with the image information and the character information which are displayed on the envelope (image display device) 100.

Moreover, as a method of outputting the image information or the character information to the envelope (image display device) 100 to display and/or reproduce the information, for example, the method can be performing as follows. First, the image signal corresponding to each pixel of the envelope (image display device) 100 is generated from the received image information or the character information. Then, the generated image signal is inputted into the drive circuit of the envelope (image display device) 100. And, based on the image signal inputted into the drive circuit, the voltage applied to each electron-emitting device in envelope (display panel) 100 from the drive circuit is controlled to display an image.

Figure 13:
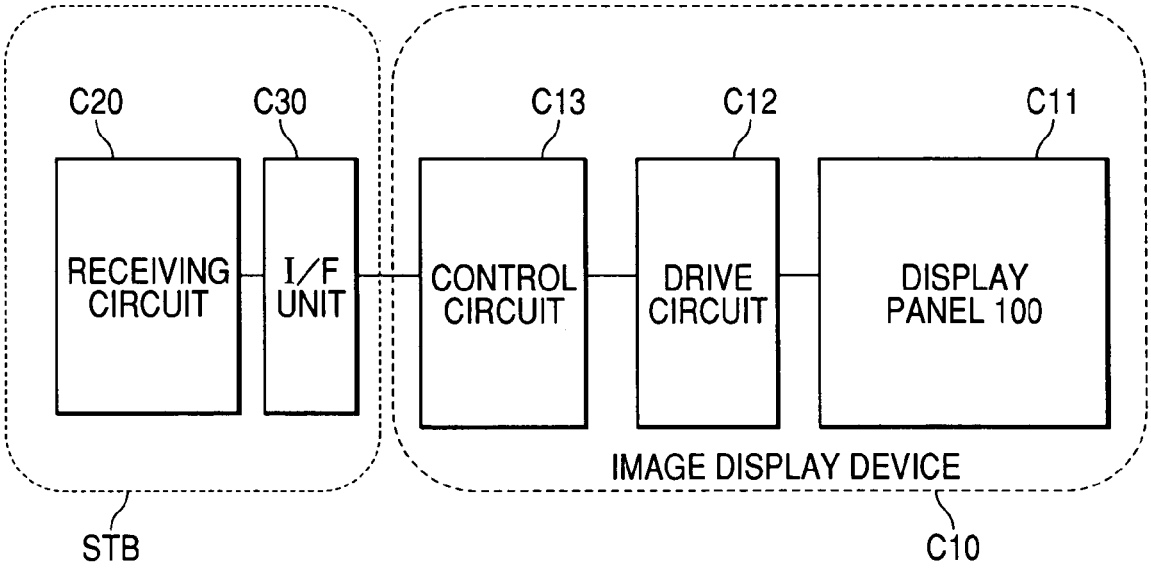
FIG. 13 is a block diagram of an example of an information display reproduction apparatus of the present invention.

FIG. 13 is a block diagram of a television apparatus according to the present invention. A receiving circuit C20 is composed of a tuner, a decoder, and the like, and receives television signals of satellite broadcasting, a ground wave and the like, data broadcasting through a network, and the like to output a decoded image data to an interface (I/F) unit C30. The I/F unit C30 converts the image data into the display format of a display device, and outputs the converted image data to the display panel 100 (C11). The image display device C10 includes the display panel 100 (C11), a drive circuit C12 and a control circuit C13. The control circuit C13 performs image processing such as correction processing suitable for the display panel 100 to the inputted image data, and outputs the image data and various control signals to the drive circuit C12. The drive circuit C12 outputs a drive signal to each wiring (see Dox1-Doxm and Doy1-Doyn in FIG. 5) of the display panel 100 (C11) based on the inputted image data, and a television image is displayed. The receiving circuit C20 and the I/F part C30 may be housed in a housing separated from the image display device C10 as a set top box (STB), or may be stored in the same housing as the image display device C10.

Moreover, the television apparatus may be configured to have interfaces connectable with an image recording apparatus, or an image outputting apparatus, such as a printer, a digital video camera, a digital camera, a hard disk drive (HDD), and a digital video disc (DVD). And, by such a configuration, the information display reproduction apparatus (or the television apparatus) can be configured to be able to display the images recorded in the image recording apparatus on the display panel 100, or to process the images displayed on the display panel 100 as the need arises and output the processed images to the image outputting apparatus.

The configuration of the image display device described here is an example of the image display device to which the present invention can be applied, and various modifications are possible for it based on the spirit of the present invention. Moreover, the image display device of the present invention can be used also as display devices of a teleconference system and a computer, and the like.

The image display device of the present invention can be used also as an image forming apparatus as an optical printer constituted using a photosensitive drum besides a display device of television broadcasting and the display devices of the teleconference system and the computer.

EXAMPLES

Hereinafter, examples of the present invention are described.

Example 1

Figure 2A:
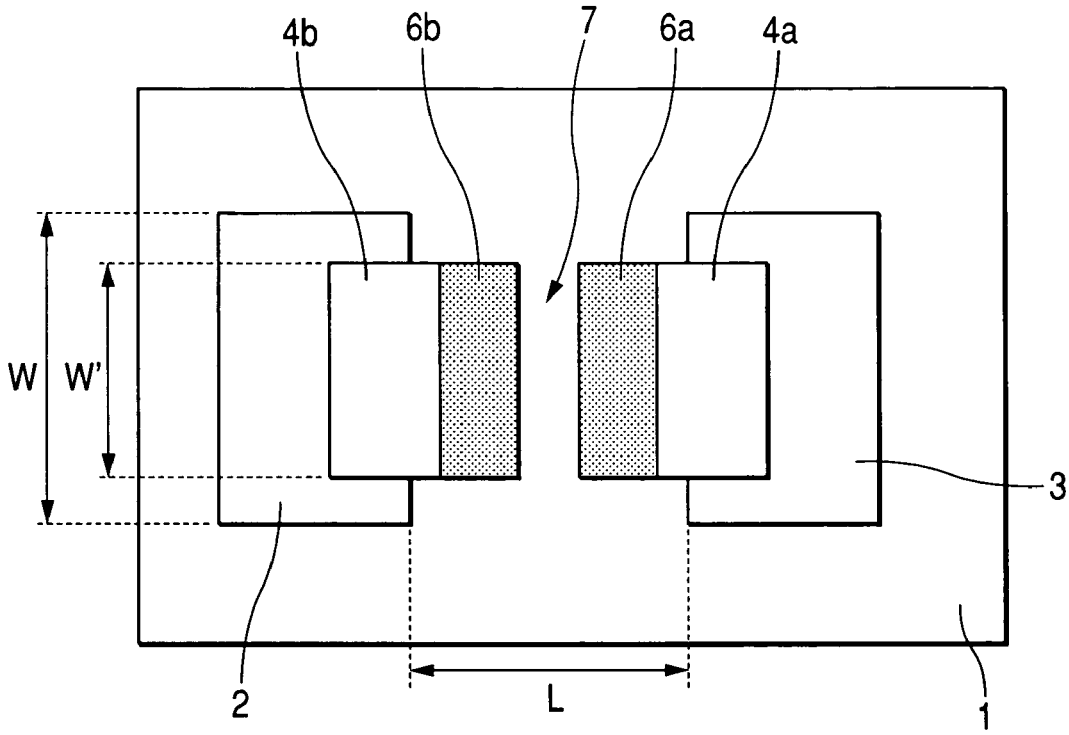
FIGS. 2A and 2B are schematic views showing the configuration of an electron-emitting device to which the present invention is applied.
Figure 2B:
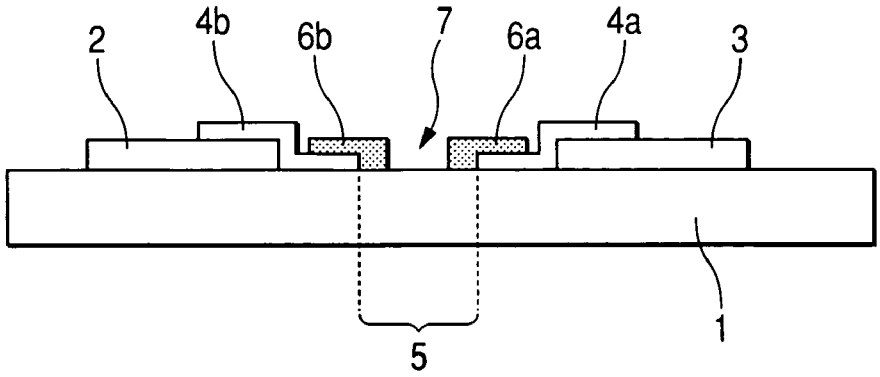

As an electron-emitting device, the electron-emitting device of the type shown in FIGS. 2A and 2B was created. FIG. 2A shows a schematic plan view, and FIG. 2B shows a schematic sectional view. In FIGS. 2A and 2B, the reference numeral 1 denotes the substrate. The reference numerals 2 and 3 denote the electrodes. The reference numeral 4*a* denotes the first electroconductive film. The reference numeral 4*b* denotes the second electroconductive film. The reference numeral 6*a* denotes the first carbon film. The reference numeral 6*b* denotes the second carbon film. The reference numeral 5 denotes the second gap. The reference numeral 7 denotes the first gap.

In the present example, one electron-emitting device was created according to the following steps.

(Step 1)

As the substrate 1, one made by laminating $SiO_2$ by sputtering vapor deposition method on a substrate which contains 67% of $SiO_2$, 4.4% of $K_2O$, and 4.5% of $Na_2O$, and has a distortion point of 570° C. was used.

(Step 2)

On the above-mentioned substrate 1, by the sputtering vapor deposition method, Ti was deposited in thickness of 5 nm, and Pt was deposited in thickness of 50 nm sequentially. A pattern which was made to be the electrodes 2 and 3 and the electrode interval L was formed with photoresist. Then, dry etching using Ar ions was performed. Thereby, the electrodes 2 and 3 were formed in which the electrode interval L was made to be 30 μm and the electrode width W was made to be 100 μm (see FIG. 3A).

(Step 3)

An organic Pd solution was spin-coated on the substrate 1 with a spinner, and the heat baking processing thereof was performed for 12 minutes at 300° C. Moreover, the sheet resistance value of the electroconductive film 4 (the film containing Pd as the main element) formed in this way was $1\times10^5$ Ω/□.

(Step 4)

The direct puttering of the electroconductive film 4 obtained at Step 3 was preformed using a laser to form a predetermined pattern (FIG. 3B). The width W' of the electroconductive film 4 was made to be 600 μm.

(Step 5)

Next, the substrate 1 was set in the measurement evaluation apparatus described with reference to FIG. 5, and the inner part thereof was exhausted with the vacuum pump 56. After the pressure of the inner part reached the degree of vacuum of $1\times10^{-3}$ Pa, a mixed gas containing 98% of nitrogen gas and 2% of hydrogen gas was introduced in the measurement evaluation equipment. The reduction of the electroconductive film 4 was promoted by the hydrogen, and palladium oxide changed to palladium. A measurement of the resistance between the electrodes 2 and 3 performed after the reduction showed the resistance to be 60 Ω. Then, after exhausting the inner part using the vacuum pump again until the pressure therein reached the degree of vacuum of $1\times10^{-3}$ Pa, a voltage was applied between the electrodes 2 and 3 using the voltage source 51 to perform the "forming step", and thereby the second gap 5 was formed (FIG. 3C). In the present example, a rectangular pulse having a pulse width $T_1$ of 1 msec and a pulse interval $T_2$ of 50 msec is boosted sot that the peak value thereof increased by a step of 0.1 V, and the "forming step" was performed. Then, the inner part of the measurement evaluation apparatus was exhausted up to $1\times10^{-6}$ Pa.

(Step 6)

Then, an ampoule sealing tolunitrile therein was introduced into the evaluation apparatus 55 shown in FIG. 5 through a slow leak valve, and the inner part of the evaluation apparatus 55 was maintained at $1.3\times10^{-4}$ Pa. Next, the pulses having the waveforms shown in FIG. 7 were outputted from the voltage source 51, and the "activation step" was performed (FIG. 3D). The waveforms shown in FIG. 7 are ones outputted from the voltage source 51 at the time of immediately after the start of the "activation step" and at the time when the control of the present invention had not performed yet. In FIG. 7, the first set voltage $V_1$ is 23 V, and the second set voltage $V_{12}$ is 21 V. Moreover, the set voltage $V_4$ was the voltage having the same absolute value as that of the first set voltage $V_1$ and having an inverse polarity to that of the first set voltage $V_1$, and was set to be −23 V. Moreover, the pulse width $T_1$ was set to 1 msec; the pulse width $T_{12}$ was set to 0.1 msec; and the pulse interval T3 was set to 0.1 msec. The period was set to 20 msec, and the necessary time of the "activation step" in the present example was for 45 minutes.

The control performed in the "activation step" of the present example is described hereinafter in detail.

(Step 0)

First, initial setting was performed. To put it concretely, the value $\beta_{set}$ was set as 0.00441, and the value $R_{unknown}$ was set as 0.

(Step 1)

The outputting of the waveform (the set voltages V ($V_1$, $V_{12}$, $V_4$)) was started from the voltage source 51.

(Step 2)

The currents I ($I_1$, $I_{12}$, $I_4$) flowing according to each of the outputted set voltages V ($V_1$, $V_{12}$, $V_4$) were measured.

(Step 3)

Then, the effective voltages V' ($V_1'$, $V_{12}'$) were calculated using the following equations from the set voltages V ($V_1$, $V_{12}$) and the measured currents I ($I_1$, $I_{12}$).

$$V_1'=V_1-I_1\times R_{unknown}$$

$$V_{12}'=V_{12}I_{12}\times R_{unknown}$$

Because the value $R_{unknown}$ was set as 0, the effective voltages V' ($V_1'$, $V_{12}'$) obtained at this stage become equal to the voltages V ($V_1$, $V_{12}$), respectively.

(Step 4)

The value $\beta_{effect}$ was calculated from the effective voltages V'. Incidentally, the calculation of the effective voltages V' performed at Steps 2 and 3 and the measurement of the currents were performed in a cycle of about 2 seconds.

Then, the processing of from Step 1 to Step 4 was repeated until the calculation result of the value $\beta_{effect}$ at Step 4 became $\beta_{effect}\leqq0.00662$. The time needed to the state of $\beta_{effect}\leqq0.00662$ was about 3 minutes after the start of the output of the waveforms shown in FIG. 7 from the voltage source 51. Incidentally, the value $R_{unknown}$ was fixed to 0 during this process.

After confirming the state of the value $\beta_{effect}\leqq0.00662$, the processing moved to the following Step 5.

(Steps 5-7)

First, the value $\beta_{effect}$ was compared with the value $\beta_{set}$. When the value $\beta_{effect}$ was different from the value $\beta_{set}$, the processing of varying (correcting) the value $R_{unknown}$ was performed.

To put it concretely, the correction value (variation width) of the value $R_{unknown}$ was set to ΔR, and k was set to a constant. Then, the correction value ΔR expressed by the following equation (3) was calculated. Then, the obtained correction value ΔR was added to the value $R_{unknown}$ to calculate a new corrected value $R_{unknown}$.

$$\Delta R=k\times(\beta_{effect}-\beta_{set}) \tag{3}$$

In the present example, the constant k was set to be 10000.

(Step 8)

By assigning the new value $R_{unknown}$ corrected using the equation (3), the measured currents I ($I_1$, $I_{12}$) measured at Step 2, and the effective voltages V' ($V_1'$, $V_{12}'$) calculated at Step 3 into the following relational expressions, new set voltages V ($V_2$, $V_{22}$) outputted from the voltage source 51 at Step 1 in the next cycle were calculated. Incidentally, the effective voltages V' ($V_1'$, $V_{12}'$) used on calculating the new set voltages V ($V_2$, $V_{22}$) were equal to the set voltages V ($V_1$, $V_{12}$) as described at Step 3. Consequently, the effective voltage $V_1'$ was 23 V, and the effective voltage $V_{12}'$ was 21 V.

$$V_1'=V_2-I_1\times R_{unknown}$$

$$V_{12}=V_{22}-I_{12}\times R_{unknown}$$

Then, a new control cycle was started by replacing the voltages outputted from the voltage source 51 at Step 1 of the next control cycle (the new control cycle) with the new set voltages V ($V_2$, $V_{22}$) calculated at Step 8, and by beginning to output the replaced set voltages V ($V_2$, $V_{22}$) from the voltage source 51. After that, the processing of from Step 2 to Step 4 was performed again, and the value $\beta_{effect}$ was calculated. Incidentally, at Step 3 of the control cycle, the new value $R_{unknown}$ calculated at Step 7 was adopted as the value $R_{unknown}$. That is, the new value $R_{unknown}$ calculated at Step 7 in the preceding control cycle was used as the value $R_{unknown}$ in Step 3 of this control cycle. Incidentally, although the processing of from Step 1 to Step 4 was repeated until the value $\beta_{effect}$ met the equation $\beta_{effect}\leqq0.00662$ in the preceding cycle, in this cycle, the value $\beta_{effect}$ was simply calculated without repeating the processing of from Step 1 to Step 4. Then, the processing shifted to Step 5, and whether the values $\beta_{effect}$ and $\beta_{set}$ were equal to each other or not was judged. When they are different from each other, the processing of from Step 6 to Step 8 was started. Then, the processing of from Step 1 to Step 5 in a new control cycle was started again.

By repeating the new control cycle described above, the control of the "activation step" was performed until the values $\beta_{effect}$ and $\beta_{set}$ became equal to each other. And at a point of time when 45 minutes had passed from the start of the "activation step", because the calculation result at Step 5 became $\beta_{effect}=\beta_{set}$, the "activation step" was ended.

Table 1 shows the values $\beta_{effect}$, the values $R_{unknown}$ (unit is Ω), and the measured currents $I_1$ (unit is mA) all calculated or measured at intervals of 5 minutes from the start of the "activation step."

TABLE 1

| | 5 min. | 10 min. | 15 min. | 20 min. | 25 min. |
|---|---|---|---|---|---|
| $\beta_{effect}$ | 0.00442 | 0.00441 | 0.00441 | 0.00442 | 0.00441 |
| $R_{unknown}$ | 54 | 54 | 60 | 64 | 69 |
| $I_1$ | 3.31 | 4.24 | 4.72 | 5.09 | 5.31 |

| | 30 min. | 35 min. | 40 min. | 45 min. |
|---|---|---|---|---|
| $\beta_{effect}$ | 0.00441 | 0.00441 | 0.00441 | 0.00441 |
| $R_{unknown}$ | 75 | 82 | 87 | 92 |
| $I_1$ | 5.47 | 5.61 | 5.82 | 5.86 |

Table 1 shows that the control was made so that the value $\beta_{effect}$ might be almost in agreement with the value $\beta_{set}$ after five minutes from the start of the "activation step." Moreover, it is found that the value $R_{unknown}$ was increasing with the lapse of time. In the present example, although the initial value of the value $R_{unknown}$ was set to 0, the value $R_{unknown}$ was varied at any time by controlling the value $\beta_{effect}$ so as to decrease the difference from the value $\beta_{set}$. By the control of the value $\beta_{effect}$ so that the value $\beta_{effect}$ is in agreement with the desired value $\beta_{set}$, it is possible that the effective voltages V' corresponding to the value $\beta_{set}$ is applied to the gap 7. Incidentally, it is gathered that the above-mentioned resistance change is generated owing to the change of the electroconductive film 4 during the "activation step."

From the present example, it is known that it is possible to obtain the resistance component connected to the gap 7 in series, and to perform the voltage compensation for the resistance component. It is also known that it is possible to apply the desired effective voltages to the gap 7.

Example 2

In the present example, the same manufacturing method is adopted until Step 5 of the manufacturing method of Example 1. And, five electron-emitting devices (electron-emitting devices B, C, D, E and F) of the type shown in FIG. 2 were created. For this reason, the description of the processing of Steps 1-5 is omitted in the following.

Incidentally, measurements of the resistance between the electrodes 2 and 3 at Step 5 after reduction show the resistance of 61 Ω, 60 Ω, 61 Ω, 62 Ω, and 61 Ω of electron-emitting devices B, C, D, E and F, respectively.

After finishing the "forming step" of Step 5, the "activation step" shown in the following was performed to each electron-emitting device.

In the present example, by connecting the resistance having a known resistance value to each electron-emitting device, resistance dispersion was created intentionally.

To put it concretely, the resistance of 100 Ω, 220 Ω, 270 Ω, and 330 Ω was inserted between each of the electron-emitting devices B, C, D, and E, and the voltage source 51. Incidentally, no resistance was inserted to the electron-emitting device F. The "activation step" shown below was performed to these five electron-emitting devices.

(Step 6)

An ampoule sealing tolunitrile therein was introduced into the inner part of the evaluation apparatus 55 through a slows leak valve, and the inner part was kept to be $1.3\times10^{-4}$ Pa. Next, the pulse voltage having the waveform shown in FIG. 7 was outputted from the voltage source 51 to each of the electron-emitting devices B, C, D, E and F like Example 1, and the "activation step" was performed.

The waveforms shown in FIG. 7 are ones outputted from the voltage source 51 at the time of immediately after the start of the "activation step" and at the time when the control of the present invention was not performed yet. In FIG. 7, the first set voltage $V_1$ is 23 V, and the second set voltage $V_{12}$ is 21 V. Moreover, the set voltage $V_4$ was the voltage having the same absolute value as that of the first set voltage $V_1$ and having an inverse polarity to that of the first set voltage $V_1$; and was set to be −23 V. Moreover, the pulse width $T_1$ was set to 1 msec; the pulse width $T_{12}$ was set to 0.1 msec; and the pulse interval $T_3$ was set to 0.1 msec. The period was set to 20 msec, and the necessary time of the "activation step" in the present example was for 45 minutes.

Incidentally, in the present example, a voltage of 100 V was applied to the anode 64 during the "activation step" in order to measure the emission current Ie.

The control performed in the present example is described hereinafter in detail. Incidentally, although it was not used for the control, the emission current Ie was measured according to the timing of the output of the first set voltage $V_1$.

(Step 0)

First, initial setting was performed. The initial setting was same to all of the electron-emitting devices B, C, D, E and F. To put it concretely, the value $\beta_{set}$ was set as 0.00441, and the value $R_{unknown}$ was set as 0.

(Step 1)

The outputting of the waveforms (the set voltages V ($V_1$, $V_{12}$, $V_4$)) shown in FIG. 7 was started from the voltage source 51.

(Step 2)

The currents I ($I_1$, $I_{12}$, $I_4$) flowing according to each of the outputted set voltages V ($V_1$, $V_{12}$, $V_4$) were measured.

(Step 3)

Then, the effective voltages V' ($V_1'$, $V_{12}'$) were calculated using the following equations from the set voltages V ($V_1$, $V_{12}$) and the measured currents I ($I_1$, $I_{12}$).

$$V_1'=V_1-I_1\times R_{unknown}$$

$$V_{12}'=V_{12}-I_2\times R_{unknown}$$

Because the value $R_{unknown}$ was set as 0, the effective voltages V' ($V_1'$, $V_{12}'$) obtained at this stage become equal to the voltages V ($V_1$, $V_{12}$), respectively.

(Step 4)

The value $\beta_{effect}$ was calculated from the effective voltages V' ($V_1$, $V_{12}'$). Incidentally, the calculation of the effective voltages V' performed at Steps 2 and 3 and the measurement of the currents were performed in a cycle of about 2 seconds.

Then, the processing moved to the next Step 5 after five minutes from the start of the "activation step" (the start of Step 1).

(Steps 5-7)

First, the value $\beta_{effect}$ calculated at Step 4 was compared with the value $\beta_{set}$ When the value $\beta_{effect}$ was different from the value $\beta_{set}$, the processing of varying (correcting) the value $R_{unknown}$ was performed.

To put it concretely, the correction value (variation width) of the value $R_{unknown}$ was set to ΔR, and k was set to a constant. Then, the correction value ΔR expressed by the following equation (3) was calculated. Then, the obtained correction value ΔR was added to the value $R_{unknown}$ to calculate a new corrected value $R_{unknown}$.

$$\Delta R=k\times(\beta_{effect}-\beta_{set}) \quad (3)$$

In the present example, the constant k was set to be 10000.

(Step 8)

By assigning the new value $R_{unknown}$ corrected using the equation (3), the measured currents I ($I_1$, $I_{12}$) measured at Step 2, and the effective voltages V' ($V_1'$, $V_{12}'$) calculated at Step 3 into the following relational expressions, new set voltages V ($V_2$, $V_{22}$) outputted from the voltage source 51 at Step 1 in the next cycle were calculated. Incidentally, the effective voltages V' ($V_1'$, $V_{12}'$) used on calculating the new set voltages V ($V_2$, $V_{22}$) were equal to the set voltages V ($V_1$, $V_{12}$) as described at Step 3. Consequently, the effective voltage $V_1'$ was 23 V, and the effective voltage $V_{12}'$ was 21 V.

$$V_1'=V_2-I_1\times R_{unknown}$$

$$V_{12}'=V_{22}-I_{12}\times R_{unknown}$$

Then, a new control cycle was started by replacing the voltages outputted from the voltage source 51 at Step 1 of the next control cycle (the new control cycle) with the new set voltages V ($V_2$, $V_{22}$) calculated at Step 8, and by beginning to output the replaced set voltages V ($V_2$, $V_{22}$) from the voltage source 51. After that, the processing of from Step 2 to Step 4 was performed again, and the value $\beta_{effect}$ was calculated. Incidentally, at Step 3 of the control cycle, the new value $R_{unknown}$ calculated at Step 7 was adopted as the value $R_{unknown}$. That is, the new value $R_{unknown}$ calculated at Step 7 in the preceding control cycle was used as the value $R_{unknown}$ in Step 3 of this control cycle. Incidentally, although the processing did not shift to Step 5 until five minutes have passed from the start (the start of Step 1) of the application of the voltage in the preceding cycle, in this new cycle, the processing immediately shifted to Step 5 after Step 4, and the value $\beta_{effect}$ was calculated. Then, at shifted Step 5, whether the values $\beta_{effect}$ and $\beta_{set}$ were equal to each other or not was judged. When they are different from each other, the processing of from Step 6 to Step 8 was started. Then, the processing of from Step 1 to Step 5 in a new control cycle was started again.

By repeating the new control cycle described above until 45 minutes have passed from the application of the voltage, the control of the "activation step" was performed so that the difference between the values $\beta_{effect}$ and $\beta_{set}$ decreased. Then, at a point of time when 45 minutes had passed from the start of the "activation step", the "activation step" was ended.

Table 2 shows the values $\beta_{effect}$ and the effective voltages $V_1'$ (unit is V) just before the stop of the application of the voltage, the operation results of the values $R_{unknown}$ (unit is Ω), the measured currents $I_1$ (unit is mA), and the measured values of the emission currents Ie (unit is μA) in each of the electron-emitting devices.

TABLE 2

| | device B | device C | device D | device E | device F |
|---|---|---|---|---|---|
| $\beta_{effect}$ | 0.00441 | 0.00441 | 0.00442 | 0.00441 | 0.00442 |
| $V_1'$ | 23.03 | 22.97 | 22.94 | 22.94 | 23.05 |
| inserted resistance | 100 | 220 | 270 | 330 | not inserted |
| $R_{unknown}$ | 181 | 309 | 352 | 403 | 95 |
| $I_1$ | 5.78 | 5.73 | 5.71 | 5.82 | 5.81 |
| Ie | 22.6 | 22.5 | 22.5 | 22.7 | 22.7 |

From Table 2, it can be read that the control was performed so that the values $\beta_{effect}$ mostly agreed with the values $\beta_{set}$ to all of the respective electron-emitting devices B, C, D, E and F. In the present example, although the initial value of the value $R_{unknown}$ was set to 0, it is known that the value $R_{unknown}$ was varied at any time by performing control for a certain predetermined period (45 minutes) so as to decrease the difference between the values $\beta_{effect}$ and $\beta_{set}$.

Consequently, the values $R_{unknown}$ were calculated mostly according to the magnitudes of the given resistance. This fact means that it is possible to apply the effective voltage corresponding to the value $\beta_{set}$ to the gap 7, as long as the value $\beta_{effect}$ is controlled using the control method of the present invention so that the value βeffect may agree with the desired value βset, or so that the difference between the values $\beta_{effect}$ and βset may decrease even if the value of the resistance connected to each electron-emitting device in series is not distinct.

Furthermore, when the values of the measured currents $I_1$ is examined, it is known that the uniformity among the respective electron-emitting devices B, C, D, E and F is high. This is conceivable that the reason is that the effective voltages applied to the gap 7 during the "activation step" of each electron-emitting device have become almost uniform. Moreover, when the values of the emission currents Ie is examined, it is known that the uniformity among the respective electron-emitting devices B, C, D, E and F is high. This is conceivable that the reason is that the effective voltages applied to the gap 7 during the "activation step" of each electron-emitting device have become almost uniform.

From those results, it is known that by unifying the effective voltages applied to the gap 7 during the "activation step" even the emission currents Ie can be unified, and that the electron-emitting devices having unified electron emission efficiencies calculated by dividing the emission currents Ie by the device currents If can be manufactured with good reproducibility as a result. This shows that it is possible to provide the electron-emitting devices having unified electron emission characteristics by applying the present invention.

Incidentally, when the electron-emitting device F is compared with the electron-emitting device created in Example 1, it is confirmed that the values $\beta_{effect}$ and the measured currents $I_1$ almost agree to show good reproducibility.

Moreover, the values of resistance added in the present example are not restricted to the above-mentioned values. Even if they are larger ones, the effective voltages V' applied to the gap 7 can be controlled by controlling the values $\beta_{effect}$ by the control method of the present invention.

Reference Example 1

In the present reference example 1, a case where the compensation of the voltages to be applied was performed on the assumption that the value of resistance did not vary from a certain value to be constant is shown. Consequently, the present reference example 1 does not include the control of presuming the resistance value $R_{unknown}$, which was performed in Examples 1 and 2.

As the reference example 1, the same manufacturing method is adopted until Step 5 of the manufacturing method of Example 1. And, two electron-emitting devices (electron-emitting devices G and H) of the type shown in FIG. 2 were created. For this reason, the description of the processing of Steps 1-5 is omitted in the following.

Incidentally, measurements of the resistance between the electrodes 2 and 3 at Step 5 after reduction show the resistance of 62 Ω and 60 Ω of electron-emitting devices G and H, respectively. After finishing the "forming step" of Step 5, the "activation step" shown in the following was performed to each electron-emitting device.

In the present reference example, by connecting the resistance having a known resistance value to each electron-emitting device, resistance dispersion was created intentionally.

To put it concretely, the resistance of 100 Ω and 330 Ω was inserted between each of the electron-emitting devices G and H, and the voltage source 51. The "activation step" shown below was performed to these two electron-emitting devices.

(Step 6)

An ampoule sealing tolunitrile therein was introduced into the inner part of the evaluation apparatus 55 through a slow leak valve, and the inner part was kept to be $1.3\times10^{-4}$ Pa. Next, the pulse voltage having the waveform shown in FIG. 7 was outputted from the voltage source 51 to each of the electron-emitting devices G and H like Example 1, and the "activation step" was performed.

The waveforms shown in FIG. 7 are ones outputted from the voltage source 51 at the time of immediately after the start of the "activation step" and at the time when the control of the present invention was not performed yet. In FIG. 7, the first set voltage $V_1$ is 23 V, and the second set voltage $V_{12}$ is 21 V. Moreover, the set voltage $V_4$ was the voltage having the same absolute value as that of the first set voltage $V_1$ and having an inverse polarity to that of the first set voltage $V_1$, and was set to be −23 V. Moreover, the pulse width $T_1$ was set to 1 msec; the pulse width $T_{12}$ was set to 0.1 msec; and the pulse interval $T_3$ was set to 0.1 msec. The period was set to 20 msec, and the necessary time of the "activation step" in the present reference example was for 45 minutes.

Incidentally, in the present reference example, a voltage of 100 V was applied to the anode 64 during the "activation step" in order to measure the emission current Ie.

And in this reference example, it was supposed that the resistance value of the resistance connected to each electron-emitting device was 270 Ω, and voltages were added to the voltages outputted from the voltage source 51 in order to compensate the amount of the voltage drop by the resistance value of the connected resistance to perform the "activation step." Consequently, because the resistance actually connected to each electron-emitting device (G, H) is 100 Ω and 330 Ω, respectively, the voltage (compensation voltage) applied to the electron-emitting device G becomes higher, and, on the other hand, the voltage (compensation voltage) applied to the electron-emitting device H becomes lower.

Because the processing is equivalent to recognizing the resistance value of the electron-emitting device G to be one larger than the actually added resistance value of 100 Ω, and compensating applied voltage, the compensation becomes overcompensation. That is, the compensation voltage applied to the electron-emitting device G becomes larger than a proper value. On the other hand, because the compensation of the electron-emitting device H is equivalent to recognizing the resistance value to be one smaller than the actually added resistance of 330 Ω to perform the compensation of the applied voltage, the compensation voltage becomes smaller than a proper value.

Moreover, because it was assumed that the resistance value was always 270 Ω, the calculation of the value $\beta_{effect}$ was not performed.

Only the current $I_1$ detected according to the output of the set voltage $V_1$ was detected. The effective voltage $V_1'$ considered to be applied to the gap 7 from the voltage $V_1$ was calculated using the following equation.

$$V_1'=V_1-I_1\times270$$

Incidentally, the calculation and the measurement of the effective voltage $V_1'$ and the measured current $I_1$ were performed in a period of about two seconds. And the voltages outputted from the voltage source 51 were controlled in a period of two seconds using the above-mentioned equation so that the calculation result of the effective voltage $V_1'$ becomes 23 V. That is, in the initial stages of the "activation step", because the first set voltage outputted from the voltage source 51 is 23 V, the control (voltage compensation) which raises the voltage outputted from the voltage source 51 is performed. Such control was ended at a point of time when 45 minutes had gone from the start (voltage application start) of the "activation step", and the "activation step" was completed.

Table 3 shows the measured values of the measured currents $I_1$ (unit is mA) and the emission currents Ie (unit is μA) just before the end (the stop of the voltage application) of the "activation step".

TABLE 3

| | device G | device H |
|---|---|---|
| $I_1$ | 5.21 | 6.82 |
| Ie | 21.9 | 20.4 |

When the values of the measured currents $I_1$ are examined in Table 3, it can be known that the measured currents $I_1$ greatly differ between the electron-emitting devices. This is conceivable that the effective voltage applied to each of the electron-emitting device G and the electron-emitting device H was not unified. Moreover, when the values of the emission currents Ie are examined, it can be known that the values differ, although the degree of the differences is not so large as that of the values of the measured currents $I_1$. From these results, it can be known that the electron-emitting devices G and H have greatly different electron emission efficiency calculated by dividing the emission current Ie by the device current If. From this fact, it can be known that it is important to control the "activation step" so as to unify the effective voltages V'.

Example 3

In the present example, the same manufacturing method is adopted until Step 5 of the manufacturing method of Example 1. And, three electron-emitting devices (electron-emitting devices J, K and L) of the type shown in FIG. 2 were created. For this reason, the description of the processing of Steps 1-5 is omitted in the following.

Incidentally, measurements of the resistance between the electrodes 2 and 3 at Step 5 after reduction show the resistance of 60 Ω, 62 Ω and 63 Ω of the electron-emitting devices J, K and L, respectively.

After finishing the "forming step" of Step 5, the "activation step" shown in the following was performed to each electron-emitting device.

In the present example, the voltages outputted from the voltage source 51 to each electron-emitting device during the "activation step" were varied. To put it concretely, the voltages of 20 V, 22 V and 24 V were applied to the electron-emitting devices J, K and L as the first set voltage $V_1$, respectively. The "activation step" performed to these three electron-emitting devices is described in the following.

(Step 6)

An ampoule sealing tolunitrile therein was introduced into the inner part of the evaluation apparatus 55 through a slow leak valve, and the inner part was kept to be $1.3\times10^{-4}$ Pa. Next, the pulse voltage having the waveform shown in FIG. 7 was outputted from the voltage source 51 to each of the electron-emitting devices J, K and L like Example 1, and the "activation step" was performed.

The waveforms shown in FIG. 7 are ones outputted from the voltage source 51 at the time of immediately after the start of the "activation step" and at the time when the control of the present invention was not performed yet. In FIG. 7, the first set voltage $V_1$ is 20 V, the second set voltage $V_{12}$ is 18 V, and the set voltage $V_4$ is −20 V to the electron-emitting device J. The first set voltage $V_1$ is 22 V, the second set voltage $V_{12}$ is 20 V, and the set voltage $V_4$ is −22 V to the electron-emitting device K. The first set voltage $V_1$ is 24 V, the second set voltage $V_{12}$ is 21 V, and the set voltage $V_4$ is −24 V to the electron-emitting device L. Moreover, the pulse width $T_1$ was set to 1 msec; the pulse width $T_{12}$ was set to 0.1 msec; and the pulse interval $T_3$ was set to 0.1 msec. The period was set to 20 msec, and the necessary time of the "activation step" was set to for 45 minutes.

Incidentally, in the present example, a voltage of 100 V was applied to the anode 64 during the "activation step" in order to measure the emission current Ie.

The control performed in the present example is described hereinafter in detail. Incidentally, although the emission current Ie was not used for the control, it was measured according to the timing of the output of the first set voltage $V_1$.

(Step 0)

First, initial setting was performed. In the initial setting, the values $R_{unknown}$ were set to be 0 to all of the electron-emitting devices J, K and L. Moreover, the values $\beta_{set}$ were set as 0.00508, 0.00461 and 0.00423 to the electron-emitting devices J, K and L, respectively.

(Step 1)

The outputting of the waveforms (the set voltages V ($V_1$, $V_{12}$, $V_4$)) shown in FIG. 7 was started from the voltage source 51.

(Step 2)

The currents I ($I_1$, $I_{12}$, $I_4$) flowing according to each of the outputted set voltages V ($V_1$, $V_{12}$, $V_4$) were measured.

(Step 3)

Then, the effective voltages V' ($V_1'$, $V_{12}'$) were calculated using the following equations from the set voltages V ($V_1$, $V_{12}$) and the measured currents I ($I_1$, $I_{12}$).

$$V_1' = V_1 - I_1 \times R_{unknown}$$

$$V_{12}' = V_{12} - I_{12} \times R_{unknown}$$

Because the value $R_{unknown}$ was set as 0, the effective voltages V' ($V_1'$, $V_{12}'$) obtained at this stage become equal to the voltages V ($V_1$, $V_{12}$), respectively.

(Step 4)

The value $\beta_{effect}$ was calculated from the effective voltages V' ($V_1'$, $V_{12}'$). Incidentally, the calculation of the effective voltages V' performed at Steps 2 and 3 and the measurement of the currents were performed in a cycle of about 2 seconds.

Then, the processing moved to the next Step 5 after five minutes from the start of the "activation step" (the start of Step 1).

(Steps 5-7)

First, the value $\beta_{effect}$ calculated at Step 4 was compared with the value $\beta_{set}$. When the value $\beta_{effect}$ was different from the value $\beta_{set}$, the processing of varying (correcting) the value $R_{unknown}$ was performed.

To put it concretely, the correction value (variation width) of the value $R_{unknown}$ was set to ΔR, and k was set to a constant. Then, the correction value ΔR expressed by the following equation (3) was calculated. Then, the obtained correction value ΔR was added to the value $R_{unknown}$ to calculate a new corrected value $R_{unknown}$.

$$\Delta R = k \times (\beta_{effect} - \beta_{set}) \quad (3)$$

In the present example, the constant k was set to be 10000.

(Step 8)

By assigning the new value $R_{unknown}$ corrected using the equation (3), the measured currents I ($I_1$, $I_{12}$) measured at Step 2, and the effective voltages V' ($V_1'$, $V_{12}'$) calculated at Step 3 into the following relational expressions, new set voltages V ($V_2$, $V_{22}$) outputted from the voltage source 51 at Step 1 in the next cycle were calculated. Incidentally, the effective voltages V' ($V_1'$, $V_{12}'$) used on calculating the new set voltages V ($V_2$, $V_{22}$) were equal to the set voltages V ($V_1$, $V_{12}$) as described at Step 3.

$$V_1' = V_2 - I_1 \times R_{unknown}$$

$$V_{12}' = V_{22} - I_{12} \times R_{unknown}$$

Then, a new control cycle was started by replacing the voltages outputted from the voltage source 51 at Step 1 of the next control cycle (the new control cycle) with the new set voltages V ($V_2$, $V_{22}$) calculated at Step 8, and by beginning to output the replaced set voltages V ($V_2$, $V_{22}$) from the voltage source 51. After that, the processing of from Step 2 to Step 4 was performed again, and the value $\beta_{effect}$ was calculated. Incidentally, at Step 3 of the control cycle, the new value $R_{unknown}$ calculated at Step 7 was adopted as the value $R_{unknown}$. That is, the new value $R_{unknown}$ calculated at Step 7 in the preceding control cycle was used as the value $R_{unknown}$ in Step 3 of this control cycle. Incidentally, although the processing did not shift to Step 5 until five minutes have passed from the start (the start of Step 1) of the application of the voltage in the preceding cycle, in this new cycle, the processing immediately shifted to Step 5 after Step 4, and the value $\beta_{effect}$ was calculated. Then, at shifted Step 5, whether the values $\beta_{effect}$ and $\beta_{set}$ were equal to each other or not was judged. When they are different from each other, the processing of from Step 6 to Step 8 was started. Then, the processing of from Step 1 to Step 5 in a new control cycle was started again.

By performing the new control cycle described above every measuring period, and by repeating the new control cycle until 45 minutes have passed from the application of the voltage, the control of the "activation step" was performed so that the difference between the values $\beta_{effect}$ and $\beta_{set}$ decreased. Then, at a point of time when 45 minutes had passed from the start of the "activation step", the "activation step" was ended.

Table 4 shows the values $\beta_{effect}$ and the effective voltages $V_1'$ (unit is V) just before the stop of the application of the voltage, the operation results of the values $R_{unknown}$ (unit is Ω), the measured currents $I_1$ (unit is mA), and the measured values of the emission currents Ie (unit is μA) in each of the electron-emitting devices.

TABLE 4

| | device J | device K | device L |
|---|---|---|---|
| $\beta_{effect}$ | 0.00507 | 0.00461 | 0.00422 |
| $V_1'$ | 20.02 | 22.03 | 23.97 |
| $R_{unknown}$ | 96 | 94 | 91 |
| $I_1$ | 7.72 | 6.86 | 5.05 |

From Table 4, it can be read that the control was performed so that the values $\beta_{effect}$ mostly agreed with the values $\beta_{set}$ to all of the respective electron-emitting devices J, K and L. In the present example, although the initial value of the value $R_{unknown}$ was set to 0, the value $R_{unknown}$ was varied at any time by performing control for a certain predetermined period (45 minutes) so as to decrease the difference between the values $\beta_{effect}$ and $\beta_{set}$. Consequently, the values $R_{unknown}$ were calculated to be almost the same degree of values.

In the present example, the voltages outputted from the voltage source 51 were set to be different values to the respective electron-emitting devices. However, by performing the control of the present invention, the values $R_{unknown}$ were calculated to be the values of almost the same degrees. Consequently, it is gathered that the condition in which the electric field strengths were almost fixed during the "activation step" of the present invention was satisfied.

As mentioned above, it can be known that, in the present invention, the voltage ranges used for the "activation step" are not limited to specific voltages, but the voltages can be applied.

Incidentally, when the voltages used for the "activation step" (the voltages outputted from the voltage source 51) are, for example, within a range of from 20 V to 30 V both inclusive, it is suitable to set the values $\beta_{set}$ within a range of from 0.00338 to 0.00508 both inclusive.

Example 4

In the present example, an example of creating an electron source and an image display device is described using the FIGS. 9A-9E, 10 and 11. The "activation step" of each electron-emitting device was basically performed by the same technique as that of Example 1.

Figure 9A:
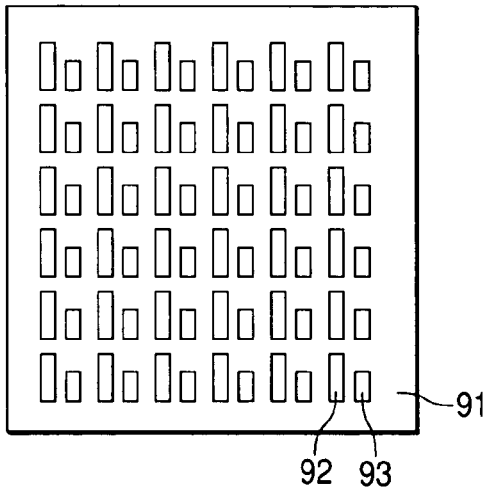
FIGS. 9A, 9B, 9C, 9D, and 9E are views schematically showing a manufacturing process of the electron source to which the present invention can be applied.
Figure 9D:
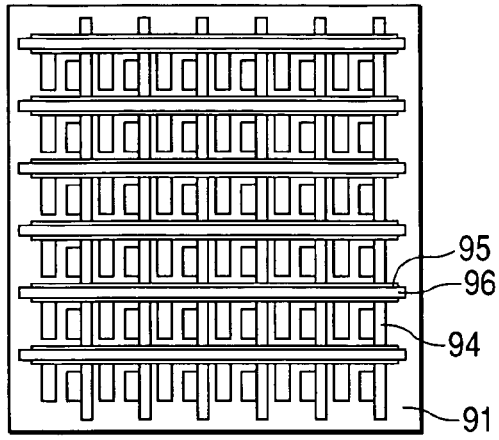
Figure 9B:
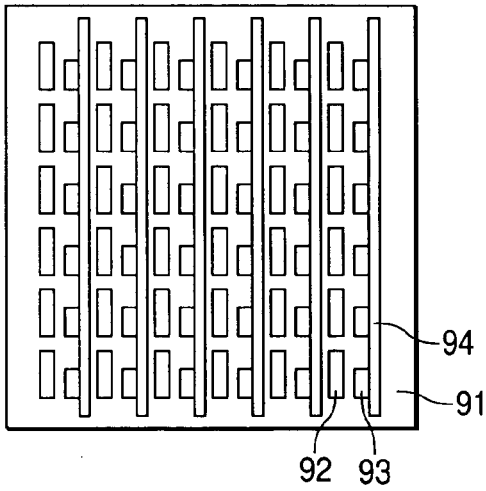
Figure 9E:
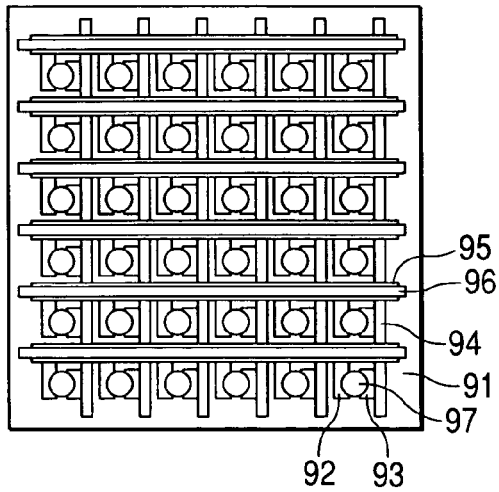

FIGS. 9A-9E are schematic plan views showing each manufacturing process of an electron source in which many electron-emitting devices are arranged in the shape of a matrix before the performance of the "forming step." FIG. 9E shows the situation of the electron source before the performance of the "forming step." In FIG. 9E, a reference numeral 91 denotes a substrate (rear plate). Reference numerals 92 and 93 denote a first electrode and a second electrode constituting each electron-emitting device. Moreover, a reference numeral 94 denotes a Y-direction wiring. A reference numeral 95 denotes an insulation film. A reference numeral 96 denotes an X-direction wiring. A reference numeral 97 denotes an electroconductive film constituting each electron-emitting device.

(Step (a))

On the substrate 91 which contains 67% of $SiO_2$, 4.4% of $K_2O$, and 4.5% of $Na_2O$, many units each including a pair of electrodes 92 and 93 were formed (FIG. 9A). The electrodes 92 and 93 were formed as follows. That is, on the substrate 91, by the sputtering technique, Ti was first formed as a film having a thickness of 5 nm as an under coating layer, and Pt was formed as a film having a thickness of 40 nm on the Ti film. After that, photoresist was coated, and patterned by a series of photolithographic method of exposure, development and etching to form the electrodes 92 and 93.

In the present example, the interval between the electrodes 2 and 3 (the interval is equivalent to the interval L in FIG. 2A) was made to be 10 μm, and their lengths (the lengths are equivalent to the widths W in FIG. 2A) were made to be 100 μm.

(Step (b))

Next, a plurality of Y-direction wirings 94 connecting a plurality of the device electrodes 93 in the Y direction in common was formed (FIG. 9B). The Y-direction wirings 94 were formed as follows. That is, a photosensitive paste containing silver (Ag) particles was used, and screen printing was performed. After that, the photosensitive paste was dried, and then was exposed and developed to a predetermined pattern. Then, the photosensitive paste was baked at a temperature about 480° C. to form the Y-direction wirings.

(Step (c))

Figure 9C:
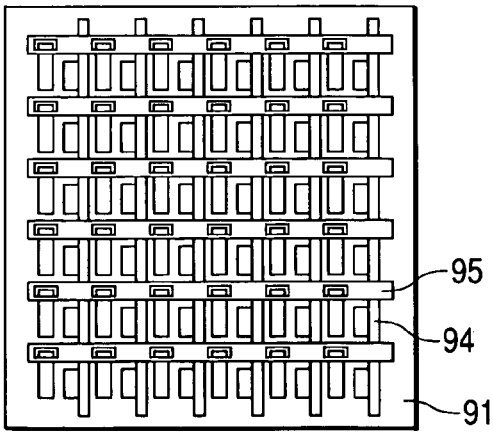

Interlayer insulation layers 95 were formed so that the interlayer insulation layers 95 intersected the Y-direction wirings 94, and so that the X-direction wirings 96, which would be described later, and the device electrodes 92 might be connected through contact holes opened at the connection parts (FIG. 9C). The interlayer insulation layers 95 were formed as follows. That is, after the screen printing of photosensitive glass paste containing PbO as the main component thereof was performed, the photosensitive glass paste was exposed and developed, and was baked at a temperature around 480° C. to form the interlayer insulation layers 95.

(Step (d))

Next, the X-direction wirings 96 were formed on the interlayer insulation layers 95 so that the X-direction wirings 96 intersected the Y-direction wirings 94 (FIG. 9D). To put it concretely, after the screen printing of a paste containing silver (Ag) particles was performed on the interlayer insulation layers 95 formed previously, the paste was dried, and was baked at a temperature around 480° C. The device electrodes 92 and the X-direction wirings 96 were connected in the contact hole parts of the interlayer insulation layers 95.

The X-direction wirings 96 are used as wirings to which scanning signals are applied.

Thus, the substrate 91 having X-Y matrix wirings was formed.

(Step (e))

Next, the liquid containing the material forming the electroconductive films 97 was coated by droplet applying means so that each electrode 92 and 93 might be connected to each other. To put it concretely, a solution containing organic Pd was used with an object of obtaining Pd films as the electroconductive films 97. The droplets of the solution were applied between the electrodes 92 and 93 after being adjusted so that the diameter of each dot might be 60 μm using an ink-jet injection apparatus using a piezoelectric device as the droplet applying means. Then, the substrate 91 was processed by being heated and baked in the air for 10 minutes at 350° C. to produce palladium oxide (PdO). The films each having the diameter of dot being 60 μm and a thickness the maximum value of which was 10 nm were obtained. By the above step, the electroconductive films 97 made from PdO were formed (FIG. 9E).

(Step (f))

Next, the "forming step" was performed.

The concrete method was as follows. The substrate 91 was arranged in the vacuum apparatus 55 having the configuration similar to the apparatus shown in FIG. 5, and the energization between each pair of the electrodes 92 and 93 was performed from the voltage source 51 through the X-direction wirings 96 and the Y-direction wirings 94. Thereby, a gap (equivalent to the second gap 5 in FIG. 2A) was formed in each of the electroconductive films 97. At this time, the "forming step" was performed under the vacuum atmosphere containing some hydrogen gas. Incidentally, the voltage waveforms used for the "forming step" were ones in accordance with the method of applying pulses with the pulse peak values being increasing as shown in FIG. 4B. The pulse width $T_1$ was set to 1 msec. The pulse interval $T_2$ was set to 50 msec. The pulse interval $T_3$ was set to 49 msec. The peak values of rectangular waves were raised by a step of 0.1 V.

(Step (g))

Next, the "activation step" was performed.

The "activation process" was performed by introducing tolunitrile into the vacuum apparatus 55, and by repeatedly applying pulse voltages between the electrodes 92 and 93 from the voltage source 51 through the X-direction wirings 96 and the Y-direction wirings 94. By the step, carbon films were deposited on the substrates 91 in the gaps 5 and on the electroconductive films 97 in the neighborhoods of the gaps 5 formed in the "forming step". At this step, p-tolunitrile was used, and the p-tolunitrile was introduced into the vacuum apparatus 55 through a slow leak valve. The pressure in the vacuum apparatus 55 was kept to be $1.3\times10^{-4}$ Pa.

In the present example, like the method shown in Example 1, in the "activation step", the control is performed so that an almost fixed voltage might be applied to the gap 7 of each electron-emitting device. Hereinafter, the control is described in detail.

First, one X-direction wiring Xn was selected among the many X-direction wirings 96, and a pulse of the waveform shown in FIG. 7 was outputted from the voltage source connected to the end on one side of the X-direction wiring Xn. Incidentally, the waveforms shown in FIG. 7 are ones outputted from the voltage source at the time when the control of the present invention is not performed immediately after the start of the "activation step." In FIG. 7, the first set voltage $V_1$ is 23 V, and the second set voltage $V_{12}$ is 21 V. Moreover, the set voltage $V_4$ is one having the same absolute value as that of the first set voltage $V_1$ and an inverse polarity to that of the fist set voltage $V_1$. The magnitude of the set voltage $V_4$ was set as −23 V. Moreover, the pulse width $T_1$ was set as 1 msec. The pulse width $T_{12}$ was set as 0.1 msec. The pulse interval $T_3$ was set as 0.1 msec. The period was set as 20 msec. The necessary time of the "activation step" to every X-direction wiring in the present example was set for 45 minutes.

The X-direction wirings 96 and the Y-direction wirings 94 each have limited resistance. Consequently, now, in a plurality of electron-emitting devices commonly connected to the selected X-direction wiring Xn (the electron-emitting devices are connected in parallel to one another), the voltage applied to them becomes smaller (the amount of the voltage drop becomes larger) as the electron-emitting device to which the voltage is applied becomes more distant from a position where the voltage source to the X-direction wiring Xn is connected.

Accordingly, pulse voltages for compensating the amounts of voltage drops generated in proportion to the distances from the position of the X-direction wiring Xn where the voltage source is connected to the respective electron-emitting devices commonly connected to the X-direction wiring Xn are applied to each of the Y-direction wirings 94 in synchronization with the timing of the pulses outputted to the X-direction wiring Xn from the voltage source. Accordingly, in the present example, the voltage values of the pulses applied to the respective Y-direction wirings 94 for compensating the amounts of voltage drops are determined in conformity with the control method of the present invention, and the effective voltages V' effectively applied to the gaps 7 of the respective electron-emitting devices are controlled.

To put it concretely, the current flowing through each of the Y-direction wirings 94 connected to each of a plurality of electron-emitting devices connected to the selected X-direction wiring Xn is measured. This current is the measured currents I ($I_1$, $I_{12}$, $I_4$) detected according to each of the set voltages V ($V_1$, $V_{12}$, $V_4$)

The control performed in the present example is described in detail.

(Step 0)

First, initial setting was performed. To put it concretely, the value $\beta_{set}$ was set as 0.00441, and the value $R_{unknown}$ was set as 0.

(Step 1)

A not shown voltage source was connected to the end of an X-direction wiring Xn selected among the X-direction wirings 96, and a not shown voltage source was connected to each end of the Y-direction wirings 94 also. Then, the application of the waveforms (the set voltages V ($V_1$, $V_{12}$, $V_4$)) shown in FIG. 7 was started.

(Step 2)

The currents I ($I_1$, $I_{12}$, $I_4$) flowing according to each of the outputted set voltages V ($V_1$, $V_{12}$, $V_4$) applied to the selected X-direction wiring Xn were measured.

(Step 3)

Then, the effective voltages V' ($V_1$', $V_{12}$') effectively applied to the gap 7 of each electron-emitting device connected to the X-direction wiring Xn were calculated using the following equations from the set voltages V ($V_1$, $V_{12}$) and the measured currents I ($I_1$, $I_{12}$).

$$V_1'=V_1-I_1\times R_{unknown}$$

$$V_{12}'=V_{12}-I_{12}\times R_{unknown}$$

Because the value $R_{unknown}$ was set as 0, the effective voltages V' ($V_1$', $V_{12}$') obtained at this stage become equal to the voltages V ($V_1$, $V_{12}$), respectively.

(Step 4)

The value $\beta_{effect}$ was calculated from the effective voltages V'. Incidentally, the calculation of the effective voltages V' performed at Steps 2 and 3 and the measurement of the currents were performed in a cycle of about 2 seconds.

Then, the processing shifted to the next step after 5 minutes from the start of the "activation step" (the start of Step 1).

(Steps 5-7)

First, the value $\beta_{effect}$ calculated at Step 4 was compared with the value $\beta_{set}$. When the value $\beta_{effect}$ was different from the value $\beta_{set}$, the processing of varying (correcting) the value $R_{unknown}$ was performed.

To put it concretely, the correction value (variation width) of the value $R_{unknown}$ was set to ΔR, and k was set to a constant. Then, the correction value ΔR expressed by the following equation (3) was calculated. Then, the obtained correction value ΔR was added to the value $R_{unknown}$ to calculate a new corrected value $R_{unknown}$.

$$\Delta R=k\times(\beta_{effect}-\beta_{set}) \quad (3)$$

In the present example, the constant k was set to be 10000.

(Step 8)

By assigning the new value $R_{unknown}$ corrected using the equation (3) and the measured currents I ($I_1$, $I_{12}$) measured at Step 2 as the currents flowing each Y-direction wiring 94 into the following relational expressions, compensation voltages $\Delta V$ ($\Delta V_1$, $\Delta V_2$) to be applied to each Y-direction wiring at Step 1 in the next cycle were calculated.

$$\Delta V_1 = I_1 \times R_{unknown}$$

$$\Delta V_{12} = I_{12} \times R_{unknown}$$

Then, a new control cycle was started by using the compensation voltages $\Delta V$ ($\Delta V_1$, $\Delta V_{12}$) calculated at Step 8 as the voltages to be applied to each Y-direction wiring 94 at Step 1 in the next control cycle (new control cycle) to be outputted from the voltage source connected to each Y-direction wiring 94.

After that, the processing of from Step 2 to Step 4 was performed again, and the value $\beta_{effect}$ was calculated. Incidentally, at Step 3 in the new control cycle, the new value $R_{unknown}$ calculated at Step 7 was adopted as the value $R_{unknown}$. That is, the new value $R_{unknown}$ calculated at Step 7 in the preceding control cycle was used as the value $R_{unknown}$ in Step 3 of this control cycle.

Incidentally, although the processing did not shift to Step 5 until five minutes had passed from the start of the voltage application (the start of Step 1) in the preceding cycle, in the new control cycle, the processing immediately shifted to Step 5 after Step 4, and calculated the value $\beta_{effect}$. Then, at the shifted Step 5, whether the values $\beta_{effect}$ and $\beta_{set}$ were equal to each other or not was judged. When the values $\beta_{effect}$ and $\beta_{set}$ were different from each other, the sequence similar to that of Steps 6-8 was started. Then, Steps 1-5 in the new control cycle were started again.

The control of the "activation step" was performed in the way of performing the new control cycle described above in each measuring period, and of repeating the control cycle until 45 minutes had passed from the start of the application of voltages so that the difference between the values $\beta_{effect}$ and $\beta_{set}$ might decrease. Then, at a point of time when 45 minutes had passed from the start of the "activation step", the "activation step" was ended.

Then, the "activation step" to all electron-emitting devices was performed by performing the same technique as the above "activation step" for every X-direction wiring selected one by one. After that, the slow leak valve was closed and the activation processing was ended.

Incidentally, in the above-mentioned example, the example in which the activation step" of the electron-emitting device connected to the X-direction wiring Xn selected among the X-direction wirings 96 had ended and then the "activation steps" of the electron-emitting devices connected to the other X-direction wirings was performed sequentially was shown. However, it is also possible to perform the "activation steps" of the electron-emitting devices connected to selected several X-direction wirings in common substantially at the same time by selecting the several X-direction wirings among the X-direction wirings 96, and by shifting the application timing of pulses to each of the several X-direction wirings.

Moreover, in the present example, to the electron-emitting devices connected to the X-direction wirings which had completed the "activation step" already, the control which reduces the difference between the value $\beta_{effect}$ and the value $\beta_{set}$ of the present invention was periodically performed until the "activation step" of all other electron-emitting devices finished. By the technique, the variations of the electron emission characteristics ($\beta_{effect}$) of the electron-emitting devices to which the "activation step" once ended were restrained.

At the above step, the substrate (rear plate) 91 which has electron sources was created. Then, the processing next moves to the step of forming the envelope 100 which constitutes the image display device shown in FIG. 10 using the substrate 1 to which the "activation step" has ended.

(Step (h))

Next, the seal bonding of the face plate 102 and the rear plate 91 was performed, and the envelope 100 shown in FIG. 10 was formed.

Figure 11A:
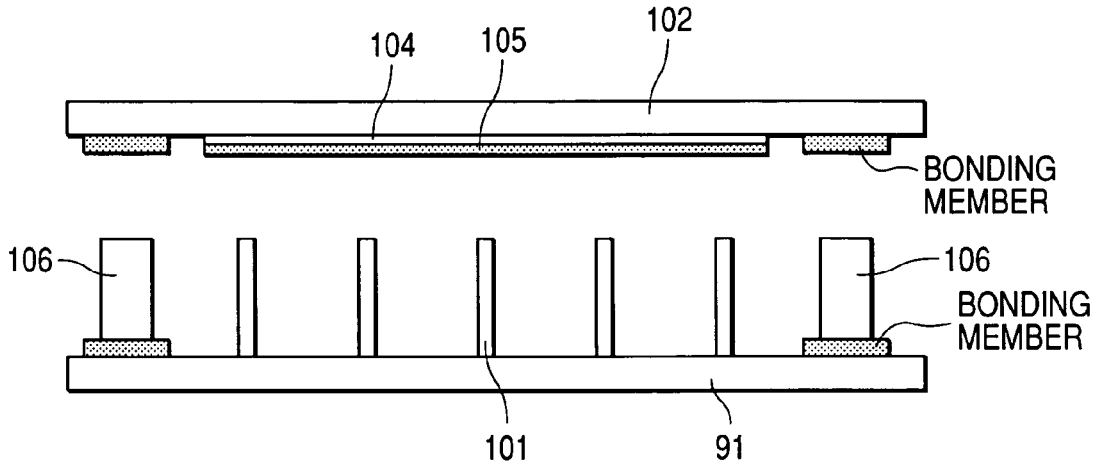
FIGS. 11A and 11B are schematic views illustrating a manufacturing process of an image display device of the present invention.
Figure 11B:
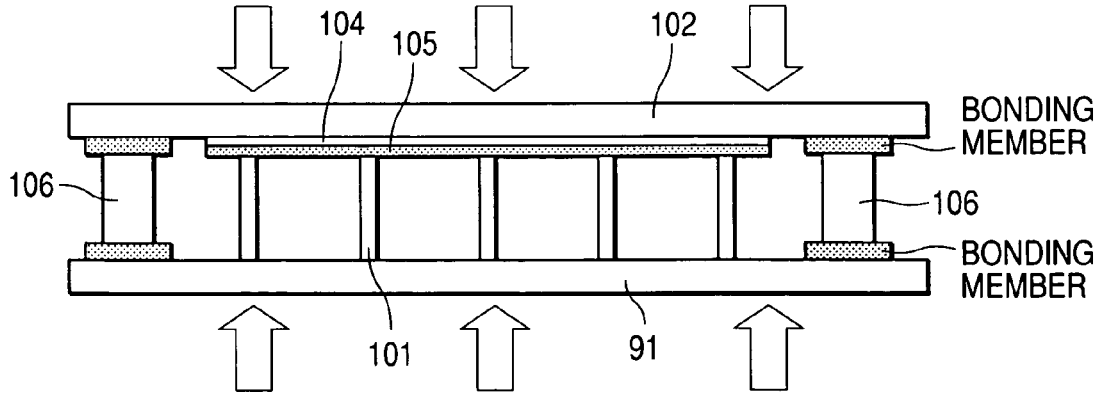

At the present step, the substrate (rear plate) 91 equipped with the electron sources created in accordance with Steps (a)-(g) and the face plate 102 including the glass substrate 103 on the inner surface of which the phosphor layer 104 and the metal back 105 made of aluminum are opposed to each other in a vacuum chamber (FIG. 11A). Next, in the vacuum chamber, seal bonding was performed by heating the face plate 102 and the rear plate 91 while pushing them so that the mutual distance might be shortened (FIG. 11 B). Incidentally, between the face plate 102 and the rear plate 91, many spacers 101 for regulating the interval between them were arranged. Moreover, the space between the face plate 102 and the rear plates 91 was hermetically held, and in order to maintain the interval between them to be 2 mm, the supporting frame 106 was also arranged. Indium was used for each bonding portion of the rear plate 91, the supporting frame 106 and the face plate 102 as both of an adhesive and a sealing material.

Incidentally, in the case where the seal bonding is performed, it is necessary to fully perform the alignment of the phosphors and the electron-emitting devices.

The image display device was configured by connecting a drive circuit to the envelope 100 of the present example formed as described above through the wirings 96 and 94. And, by applying a voltage to each electron-emitting device, electrons were emitted from the desired electron-emitting device. By applying a voltage to the metal back 105, being the anode electrode, through the high voltage terminal Hv so that the potential difference between the electron-emitting device and the metal back 105 might be 10 kV, an image was displayed.

When the image was displayed on the image display device created in the present example, the very smooth image was able to be displayed. This is because there is little dispersion of the luminance of the adjoining pixels. And this is derived from the highness of the uniformity of the characteristics of the electron-emitting devices corresponding to the respective pixels, and this is conceivable because effective voltages V' applied to the respective electron-emitting devices could be almost uniform in the "activation step."

Incidentally, the configuration of the image display device to which the present invention can applied can be variously modified based on the spirit and the scope of the present invention.

This application claims priority from Japanese Patent Application No. 2004-195699 filed on Jul. 1, 2004, which is hereby incorporated by reference herein.

What is claimed is:

1. A method of manufacturing an electron-emitting device comprising a voltage applying step of applying a voltage between a first electroconductive film and a second electroconductive film opposed to each other forming a gap therebetween in an atmosphere including a gas containing carbon, wherein the voltage applying step includes:

(A-1) a first measuring step of applying a first set voltage and a second set voltage different from the first set voltage between the first electroconductive film and the second electroconductive film, and measuring a first measuring current and a second measuring current flowing between the first electroconductive film and the second electroconductive film in response to the first set voltage and the second set voltage;

(B-1) a first calculating step of calculating a first effective voltage and a second effective voltage, which are effectively applied to the gap according to the applying of the first and second set voltages, based on the first and second measuring currents and the first and second set voltages, and, based on the calculating result, calculating a value $\beta_{effect}$ satisfying a following equation (1);

wherein, when there is a difference between the effective field enhancement factor value $\beta_{effect}$ calculated and a predetermined set field enhancement factor value $\beta_{set}$, the first and second set voltages to be applied between the first electroconductive film and the second electroconductive film are set newly so as to reduce the difference, (A-2) a second measuring step of applying the newly set first set voltage and the newly set second set voltage between the first electroconductive film and the second electroconductive film, and measuring a new first measuring current and a new second measuring current flowing between the first electroconductive film and the second electroconductive film in response to the newly set first set voltage and the newly set second set voltage; and (B-2) a second calculating step of calculating a new first effective voltage and a new second effective voltage, which are effectively applied to the gap according to the applying of the newly set first and second set voltages, based on the new first and second measuring currents and the newly set first and second set voltages, and, based on the new calculating result, calculating a new value $\beta_{effect}$ satisfying a following equation (1), wherein $$\beta_{effect}=\{(1/\text{first effective voltage})-(1/\text{second effective voltage})\}/\{\ln(\text{second measuring current}/\text{second effective voltage}^2)-\ln(\text{first measuring current}/\text{first effective voltage}^2)\} \quad (1).$$

2. A method of manufacturing an electron-emitting device according to claim 1, wherein the first effective voltage is a value obtained by assigning a preset initial value $R_1$ to $R_{unknown}$ in a following equation (2), and by assigning a combination of the first set voltage and the first measuring current to a set voltage and a measuring current in the following equation (2); and the second effective voltage is a value obtained by assigning the preset initial value $R_1$ to $R_{unknown}$ in the following equation (2), and by assigning a combination of the second set voltage and the second measuring current to the set voltage and the measuring current in the following equation (2), $$\text{effective voltage}=\text{set voltage}-\text{measuring current}\times R_{unknown} \quad (2).$$

3. A method of manufacturing an electron-emitting device according to claim 2, wherein when the $\beta_{effect}$ is larger than the $\beta_{set}$, the newly set first set voltage and the newly set second set voltage are obtained by assigning a value $R_2$ larger than the preset initial value $R_1$ to $R_{unknown}$ in equation (2) and by assigning the combination of the first set voltage and the first measuring current and the combination of the second set voltage and the second measuring current respectively to the set voltage and the measuring current in the equation (2), and when the $\beta_{effect}$ is smaller than the $\beta_{set}$, the newly set first set voltage and the newly set second set voltage are obtained by assigning a value $R_3$ smaller than the preset initial value $R_1$ to $R_{unknown}$ in equation (2) and by assigning the combination of the first set voltage and the first measuring current and the combination of the second set voltage and the second measuring current respectively to the set voltage and the measuring current in the equation (2).

4. A method of manufacturing an electron-emitting device according to claim 1, wherein when there is a difference between the $\beta_{effect}$ and the $\beta_{set}$, the voltage applying step is repeated until the difference is eliminated, or converged.

5. A method of manufacturing an electron-emitting device according to claim 1, wherein the first set voltage and the second set voltage are repeatedly applied between the first and second electroconductive films at specified time intervals in a state of being included in a step-wise pulse.

6. A method of manufacturing an electron-emitting device according to claim 1, wherein the first measuring step and the first calculating step are repeated until the value $\beta_{effect}$ is reduced into a value within ±50% of the value $\beta_{set}$.

7. A method of manufacturing an electron-emitting device according to claim 1, wherein the first set voltage or the second set voltage is 15 V-60 V.

8. A method of manufacturing an electron-emitting device according to claim 1, wherein the value $R_1$ is 0 Ω-40 k Ω.

9. A method of manufacturing an electron-emitting device according to claim 1, wherein the value $\beta_{set}$ is 0.00338-0.00508.

10. A method of manufacturing an electron source equipped with a plurality of electron-emitting devices, wherein each of said plurality of electron-emitting device is manufactured by said method according to claim 1.

11. A method of manufacturing an image display device equipped with an electron source and a light emitting body, wherein said electron source is manufactured by said method according to claim 10.

12. A method of manufacturing an information display reproduction apparatus equipped with at least a receiver outputting at least one of image information, character information, and sound information included in a received broadcast signal, and an image display device connected to said receiver, wherein said image display device is manufactured by said method according to claim 11.

* * * * *